US008616681B2

(12) United States Patent
Hagiwara et al.

(10) Patent No.: US 8,616,681 B2
(45) Date of Patent: Dec. 31, 2013

(54) LIQUID EJECTING HEAD UNIT AND LIQUID EJECTING APPARATUS

(75) Inventors: Hiroyuki Hagiwara, Matsumoto (JP); Masayuki Eguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/273,147

(22) Filed: Oct. 13, 2011

(65) Prior Publication Data

US 2012/0092415 A1 Apr. 19, 2012

(30) Foreign Application Priority Data

Oct. 18, 2010 (JP) ..... 2010-233391

(51) Int. Cl.

| | |
|---|---|
| ***B41J 2/135*** | (2006.01) |
| ***B41J 2/235*** | (2006.01) |
| ***B41J 2/145*** | (2006.01) |
| ***B21D 53/76*** | (2006.01) |

(52) U.S. Cl.
USPC ..... 347/44; 29/890.1; 347/40

(58) Field of Classification Search
USPC ..... 347/40, 44; 29/890.1
See application file for complete search history.

(56) References Cited

U.S. PATENT DOCUMENTS

| | | | | |
|---|---|---|---|---|
| 4,730,197 | A * | 3/1988 | Raman et al. | 347/40 |
| 6,575,557 | B2 | 6/2003 | Tominaga | |
| 6,604,817 | B2 * | 8/2003 | Isono et al. | 347/71 |
| 7,918,529 | B2 | 4/2011 | Mitsuzawa | |
| 7,980,645 | B2 | 7/2011 | Ohtsuka et al. | |
| 8,016,383 | B2 | 9/2011 | Mizutani et al. | |
| 2003/0085943 | A1 * | 5/2003 | Nakamura et al. | 347/19 |
| 2010/0188461 | A1 * | 7/2010 | Hagiwara et al. | 347/44 |
| 2010/0225694 | A1 * | 9/2010 | Suzuki | 347/14 |

FOREIGN PATENT DOCUMENTS

| | | |
|---|---|---|
| JP | 2007-090327 | 4/2007 |

* cited by examiner

*Primary Examiner* — Matthew Luu
*Assistant Examiner* — Alexander D Shenderov
(74) *Attorney, Agent, or Firm* — Workman Nydegger

(57) ABSTRACT

A recording head includes flange portions to which spacers are anchored on both sides of the recording head with a head case therebetween. Spacer attachment holes are provided in the flange portions in the center of the width direction orthogonal to a nozzle row in the recording head, and a round hole and an oblong hole relative to the spacers are provided in the flange portions in positions that are distanced from a center line in the width direction. Positioning holes for the flange portions are provided in the spacers in positions that correspond to the round hole and the oblong hole in the flange portions, and the spacers are anchored to the flange portions on both sides so as to be oriented symmetrically to each other, in a positioned state in which the positions of the positioning holes are aligned with the round hole and the oblong hole.

7 Claims, 18 Drawing Sheets

LIQUID EJECTING HEAD UNIT AND LIQUID EJECTING APPARATUS

The entire disclosure of Japanese Patent Application No: 2010-233391, filed Oct. 18, 2010 is expressly incorporated by reference herein.

BACKGROUND

1. Technical Field

The present invention relates to liquid ejecting head units used in liquid ejecting apparatuses such as ink jet recording apparatuses and to liquid ejecting apparatuses, and particularly relates to liquid ejecting head units and liquid ejecting apparatuses in which a plurality of liquid ejecting heads can be attached to a head anchoring member in a removable state.

2. Related Art

A liquid ejecting apparatus is an apparatus that includes a liquid ejecting head capable of ejecting a liquid as droplets, and that ejects various types of liquid from this liquid ejecting head. An image recording apparatus such as an ink jet recording apparatus (a printer) that includes an ink jet recording head (called simply a "recording head" hereinafter) and carries out recording by ejecting ink in liquid form through nozzles in the recording head as ink droplets can be given as an example of such a liquid ejecting apparatus. Meanwhile, in recent years, liquid ejecting apparatuses are being used in various types of manufacturing apparatuses, such as display manufacturing apparatuses, in addition to such image recording apparatuses. While a recording head in an image recording apparatus ejects ink in liquid form, a coloring material ejecting head in a display manufacturing apparatus ejects R (red), G (green), and B (blue) coloring material solutions. Likewise, an electrode material ejecting head in an electrode formation apparatus ejects an electrode material in liquid form, and a bioorganic matter ejecting head in a chip manufacturing apparatus ejects a bioorganic matter solution.

In recent years, there are, among such printers, printers that employ a configuration in which a single head unit is configured by arranging and anchoring a plurality of recording heads, each of which includes a plurality of nozzle rows formed by arranging a plurality of nozzles in rows, on a head anchoring member such as a sub-carriage or the like (that is, a multi-head type). In a configuration in which each recording head is positioned relative to the sub-carriage and is then screwed down onto the sub-carriage, the recording heads are temporarily anchored to the sub-carriage using an adhesive (for example, an instant adhesive) after being positioned and before being screwed down. As a result, it is possible to prevent the positions of the recording heads from shifting due to the rotational momentum occurring due to the screwing-down carried out in order to permanently anchor the recording heads using screws. When carrying out such temporary anchoring using an adhesive, however, it is difficult to remove the recording heads that have been anchored to the sub-carriage in order to repair or replace those recording heads. In response to such a problem, a configuration has been proposed in which an intermediate member called a "spacer" is provided between a recording head and a sub-carriage (for example, JP-A-2007-90327). According to this configuration, the recording head is first anchored to the spacer using screws, the spacer is then temporarily anchored to the sub-carriage using an adhesive, and then the spacer is permanently anchored to the sub-carriage using screws; accordingly, the recording head that has been anchored to the sub-carriage can be removed from the spacer and the sub-carriage by removing the screws between the recording head and the spacer. This makes it possible to remove the recording head with ease in order to replace or repair the recording head.

Incidentally, spacers employed in the aforementioned multi-head printers are formed as frame shapes that enclose the outer periphery of each recording head. Accordingly, when attaching each recording head to the sub-carriage, it has been necessary to provide a space between adjacent recording heads equivalent to the amount of space taken up by the spacers. For this reason, there has been a problem in that the dimension of the sub-carriage in the direction in which the heads are arranged is increased, which makes it difficult to reduce the size of the head unit, the printer, and so on.

In light of this issue, in recent years, a configuration has been proposed in which attachment portions such as flange portions or the like, to which spacers can be attached, are provided on both ends of each recording head in the direction that is orthogonal to the direction in which the recording heads are arranged, and two individual spacers that are smaller in size than past spacers are attached to the respective attachment portions. Through this, the intervals at which the recording heads are disposed on the sub-carriage can be reduced, which makes it possible to contribute to a reduction in the size of the head unit.

However, in the case where two spacers are used to attach a single recording head and the size of the spacers is reduced, the surface area where the recording head makes contact with the spacers is also reduced. Accordingly, there have been cases where recording heads have been tilted relative to the sub-carriage, particularly in cases where variations in the shapes, dimensions, and so on have occurred between the spacers on both ends.

It should be noted that this type of problem is not limited to ink jet recording apparatuses provided with recording heads that eject ink; the same problem can occur in other liquid ejecting head units, and liquid ejecting apparatuses provided therewith, that employ a configuration in which liquid ejecting heads are anchored to a head anchoring member such as the aforementioned sub-carriage with an intermediate member such as a spacer provided therebetween.

SUMMARY

It is an advantage of some aspects of the invention to provide a liquid ejecting head unit in which a liquid ejecting head can be attached with high positional accuracy to a head anchoring member with an intermediate member provided therebetween, and to provide a liquid ejecting apparatus that includes such a liquid ejecting head unit.

A liquid ejecting head unit according to an aspect of the invention includes: a liquid ejecting head including a nozzle formation surface in which a nozzle row configured by arranging a plurality of nozzles that eject a liquid in a row is formed; and a head anchoring member to which the liquid ejecting head is anchored with intermediate members provided therebetween. The liquid ejecting head includes intermediate member anchoring portions, to which the intermediate member is anchored, at both ends with a main head unit therebetween; intermediate member attachment holes for attaching the intermediate members are provided in each of the intermediate member anchoring portions in the center of the width direction that is orthogonal to the nozzle row in the liquid ejecting head, and head-side positioning holes that serve as a reference for positioning relative to the intermediate member are provided in the intermediate member anchoring portion in positions that are distanced from a centerline of the width direction; intermediate member-side positioning holes that serve as a reference for positioning relative to the intermediate member anchoring portions are provided in each intermediate member in a position that corresponds to the head-side positioning hole of the corresponding intermediate member anchoring portion; and the intermediate members are anchored to the intermediate member anchoring portions on both sides so as to be oriented symmetrically to each other, in a positioned state in which the positions of the intermediate member-side positioning holes are aligned with the head-side positioning holes.

According to this configuration, the liquid ejecting head includes the intermediate member anchoring portions to which the intermediate members are anchored on both sides thereof with the main head unit therebetween, the intermediate member attachment holes for attaching the intermediate members are provided in intermediate member anchoring portions in the center of the width direction orthogonal to the nozzle row in the liquid ejecting head and the head-side positioning holes that serve as a reference for positioning relative to the intermediate members are provided in the intermediate member anchoring portions in positions that are distanced from the center line in the width direction, the intermediate member-side positioning holes that serve as a reference for positioning relative to the intermediate member anchoring portions are provided in the intermediate members in positions that correspond to the head-side positioning holes in the intermediate member anchoring portions, and the intermediate members are anchored to the intermediate member anchoring portions on both sides so as to be oriented symmetrically to each other, in a positioned state in which the positions of the intermediate member-side positioning holes are aligned with the head-side positioning holes; accordingly, the intermediate members anchored to the respective intermediate member anchoring portions on both sides of the liquid ejecting head can be configured in the same shape. As a result, tilting of the liquid ejecting head that has been positioned on the head anchoring member can be suppressed to the greatest extent possible. Furthermore, because the intermediate member-side positioning holes are provided in a total of two locations in the intermediate members in correspondence to the head-side positioning holes in the intermediate member anchoring portions on both sides of the liquid ejecting head, it is possible to commonalize the intermediate members on both sides even in a configuration in which positioning holes are provided in positions distanced from the center line in the width direction of the intermediate member anchoring portion by necessity due to the relationship between reducing to the greatest extent possible the size of the intermediate members and providing the intermediate member attachment holes in the center of the intermediate member anchoring portions. Through this, variation in the shapes and dimensions of the intermediate members can be reduced.

According to another aspect of the invention, it is preferable that, in the aforementioned configuration, a configuration be employed in which each of the intermediate members anchored to the same liquid ejecting head is manufactured from the same metal mold.

According to this configuration, each of the intermediate members anchored to the same liquid ejecting head are manufactured from the same metal mold, and thus variation in the shapes and dimensions of the intermediate members is reduced even further. Accordingly, tilting of the liquid ejecting head that has been positioned on the head anchoring member can be suppressed with even greater certainty.

According to another aspect of the invention, it is preferable that, in the aforementioned configuration, a configuration be employed in which the width of the intermediate members in the direction orthogonal to the nozzle row is narrower than the width of the liquid ejecting head in the direction orthogonal to the nozzle row.

According to this configuration, the width of the intermediate members in the direction orthogonal to the nozzle row is narrower than the width of the liquid ejecting head in the direction orthogonal to the nozzle row, and thus in the case where a plurality of liquid ejecting heads have been disposed in a row upon the head anchoring member, interference among intermediate members between adjacent liquid ejecting heads is prevented. Accordingly, the pitch of the liquid ejecting heads can be reduced, which can contribute to a reduction in the size of the liquid ejecting head unit.

According to another aspect of the invention, it is preferable that, in the aforementioned configuration, a configuration be employed in which each of the head-side positioning holes of the intermediate member anchoring portions on both sides of the liquid ejecting head is provided in positions that are distanced by the same amount from the center line toward one side in the direction orthogonal to the nozzle row.

According to another aspect of the invention, it is preferable that, in the aforementioned configuration, a configuration be employed in which of the head-side positioning holes provided in the intermediate member anchoring portions on both sides of the liquid ejecting head, one of the holes is round in shape, and the other of the holes is an oblong hole that is longer in the direction in which the positioning holes are arranged.

According to this configuration, when positioning the intermediate members relative to the intermediate member anchoring portions by inserting positioning pins of tools, which are provided in correspondence to the head-side positioning holes in the intermediate member anchoring portions on both sides of the liquid ejecting head, into the head-side positioning holes and the intermediate member-side positioning holes, the error between the interval between the head-side positioning holes and the interval between the positioning pins is allowed within the range of a gap arising between the oblong holes and the positioning pins.

According to another aspect of the invention, it is preferable that, in the aforementioned configuration, a configuration be employed in which a wrapping process is carried out simultaneously on contact surfaces, in the intermediate members anchored to the liquid ejecting head, into which the intermediate member anchoring portions come into contact.

According to this configuration, a wrapping process is carried out simultaneously on contact surfaces, in the intermediate members anchored to the same liquid ejecting head, with which the intermediate member anchoring portions come into contact, and thus error in the shapes and dimensions of the intermediate members is reduced further. Accordingly, tilting of the liquid ejecting head that has been positioned on the head anchoring member can be suppressed with an even higher level certainty.

A liquid ejecting apparatus according to another aspect of the invention is provided with a liquid ejecting head unit that includes a liquid ejecting head having a nozzle formation surface in which a nozzle row configured by arranging a plurality of nozzles that eject a liquid in a row is formed and a head anchoring member to which the liquid ejecting head is anchored with intermediate members provided therebetween. The liquid ejecting head includes intermediate member anchoring portions, to which the intermediate member is anchored, at both ends with a main head unit therebetween; intermediate member attachment holes for attaching the intermediate member are provided in each of the intermediate member anchoring portions in the center of the width direction that is orthogonal to the nozzle row in the liquid ejecting head, and head-side positioning holes that serve as a reference for positioning relative to the intermediate member are provided in the intermediate member anchoring portion in positions that are distanced from a centerline of the width direction; intermediate member-side positioning holes that serve as a reference for positioning relative to the intermediate member anchoring portions are provided in each intermediate member in a position that corresponds to the head-side positioning hole of the corresponding intermediate member anchoring portion; and the intermediate members are anchored to the intermediate member anchoring portions on both sides so as to be oriented symmetrically to each other, in a positioned state in which the positions of the intermediate member-side positioning holes are aligned with the head-side positioning holes.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. An ink jet recording apparatus (referred to as a "printer") will be given hereinafter as an example of a liquid ejecting apparatus according to the invention.

Figure 1:
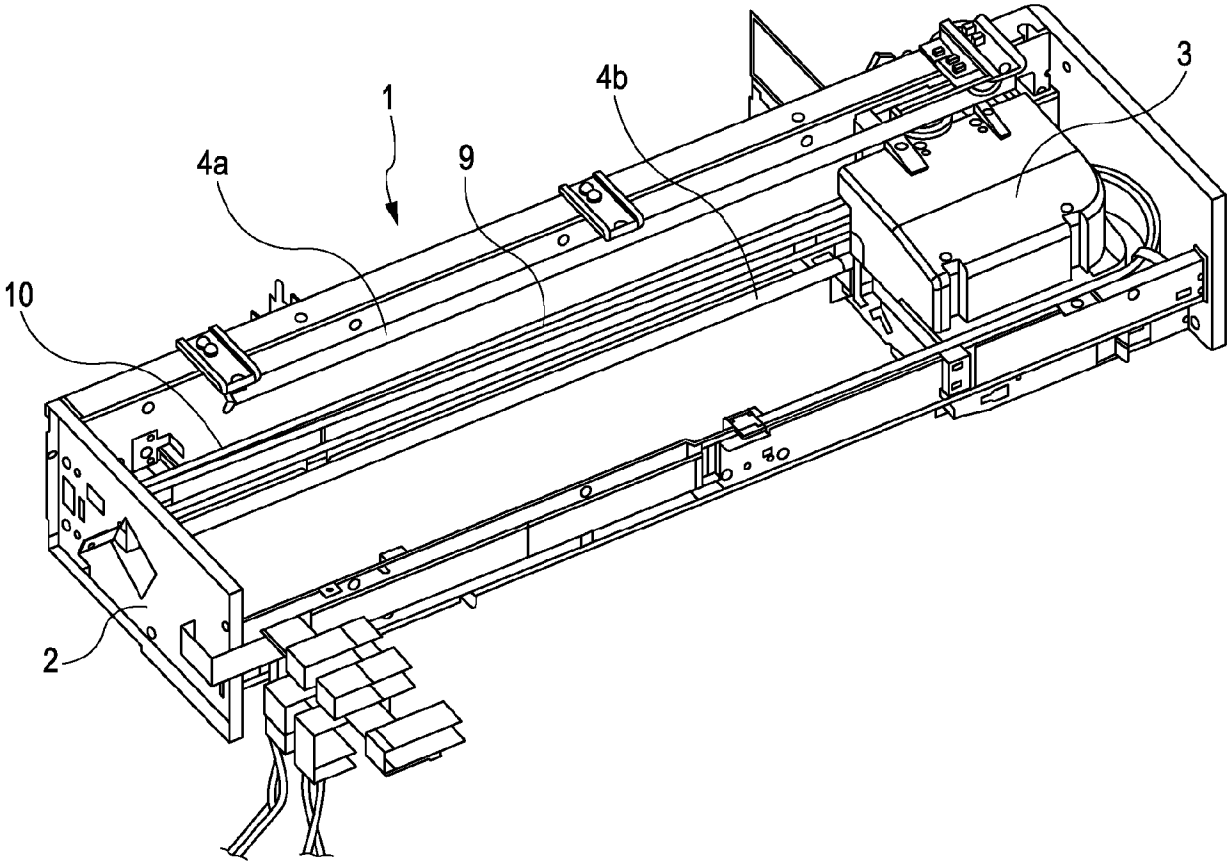
FIG. 1 is a perspective view illustrating part of the internal configuration of a printer.
Figure 2:
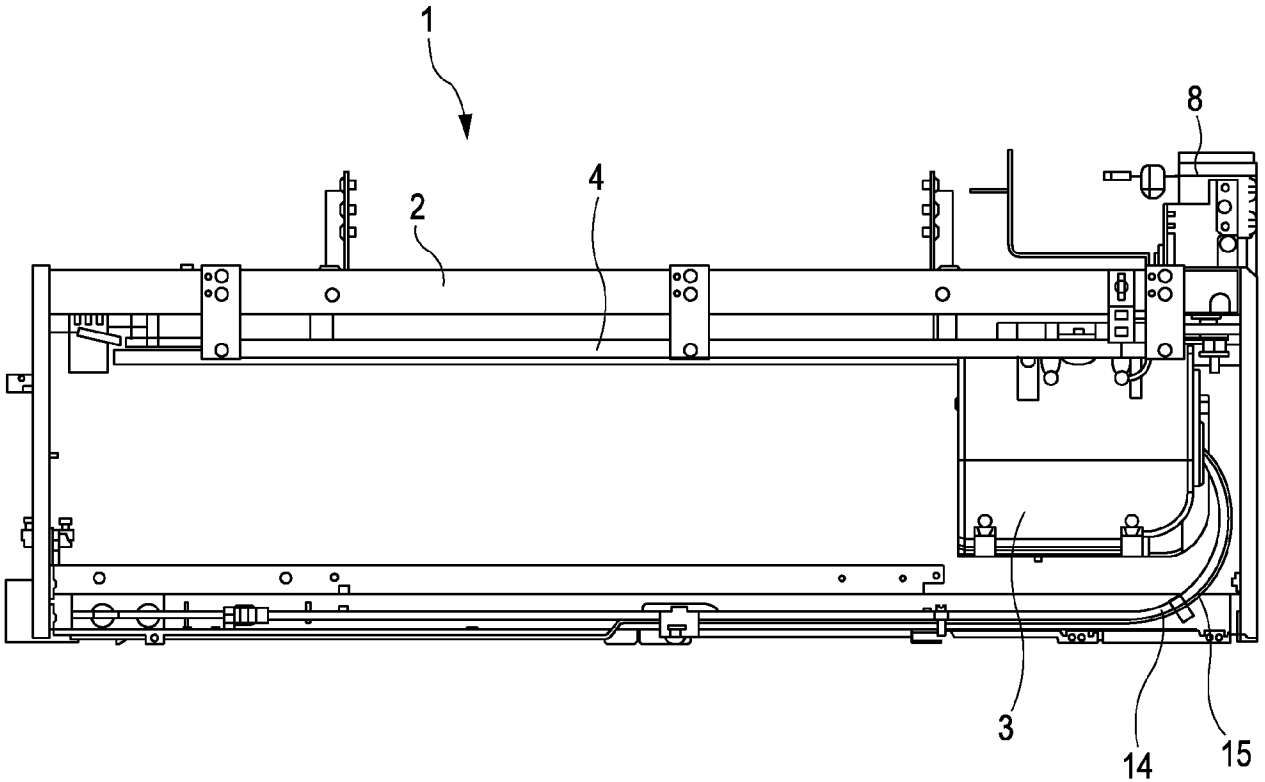
FIG. 2 is a plan view illustrating part of the internal configuration of a printer.

FIG. 1 is a perspective view illustrating part of the internal configuration of a printer 1, and FIG. 2 is a plan view of the printer 1. The printer 1 illustrated as an example ejects ink, which is a type of liquid, toward a recording medium (landing target) such as recording paper, cloth, film, or the like. The printer 1 has a carriage 3 (a type of head unit holding member) mounted within a frame 2 so as to be capable of moving back and forth in the main scanning direction, which is the direction orthogonal to the feed direction of the recording medium. A pair of upper and lower long guide rods 4*a* and 4*b* that extend along the lengthwise direction of the frame 2 are attached to an inner wall of the frame 2 at the rear surface side of the printer 1 so as to be parallel to each other with a gap provided therebetween. The guide rods 4*a* and 4*b* interlock with a shaft receiving portion 7 (see FIG. 4) and the like provided on the rear surface side of the carriage 3, and thus the carriage 3 is supported so as to be capable of sliding along the guide rods 4*a* and 4*b*.

A carriage motor 8, serving as a driving source for moving the carriage 3, is disposed on the rear surface side of the frame 2 and at one end of the main scanning direction (that is, the right end in FIG. 2). The drive shaft of this carriage motor 8 protrudes from the rear surface side of the frame 2 toward the inside, and a driving pulley (not shown) is connected to the tip portion thereof. This driving pulley is rotated by the driving of the carriage motor 8. Meanwhile, a slave pulley (not shown) is provided in a location at the opposite side in the main scanning direction as the driving pulley (the left end in FIG. 2). A timing belt 9 is stretched across these pulleys. The carriage 3 is connected to this timing belt 9. When the carriage motor 8 is driven, the timing belt 9 rotates in accordance with the rotation of the driving pulley, which in turn causes the carriage 3 to move in the main scanning direction along the guide rods 4*a* and 4*b*.

A linear scale 10 (encoder film) extends along the inner wall on the rear surface of the frame 2, along the main scanning direction and parallel to the guide rods 4*a* and 4*b*. The linear scale 10 is a band-shaped member manufactured of a transparent resin film, and is, for example, a member in which a plurality of non-transparent stripes that cut across the width direction of the band are printed upon the surface of a transparent base film. Each stripe has the same width, and the stripes are formed at a constant pitch along the lengthwise direction of the band. In addition, a linear encoder (not shown) for optically reading the stripes on the linear scale 10 is provided on the rear surface side of the carriage 3. The linear encoder is a type of position information output unit, and outputs an encoder pulse based on the scanning position of the carriage 3 as position information in the main scanning direction. Through this, a control unit (not shown) in the printer can control recording operations performed by a head unit 17 onto a recording medium while recognizing the scanning position of the carriage 3 based on the encoder pulse. The printer 1 is configured so as to be capable of a so-called bidirectional recording process, in which text, images, or the like are recorded onto the recording paper both when the carriage 3 is outbound, moving from a home position at one end of the main scanning direction toward the opposite end (a full position) and when the carriage 3 is inbound, returning from the full position to the home position.

As shown in FIG. 2, ink supply tubes 14 for supplying respective colors of ink to respective recording heads 18 in the head unit 17, and a signal cable 15 for supplying signals such as driving signals, are connected to the carriage 3. In addition, although not shown, the printer 1 is provided with a cartridge mounting portion in which ink cartridges (liquid supply sources) that hold ink are attached in a removable state, a transport unit for transporting the recording paper, a capping unit for capping nozzle formation surfaces 53 (see FIG. 12) of the recording heads 18 while the recording heads 18 are in a standby state, and so on.

Figure 3:
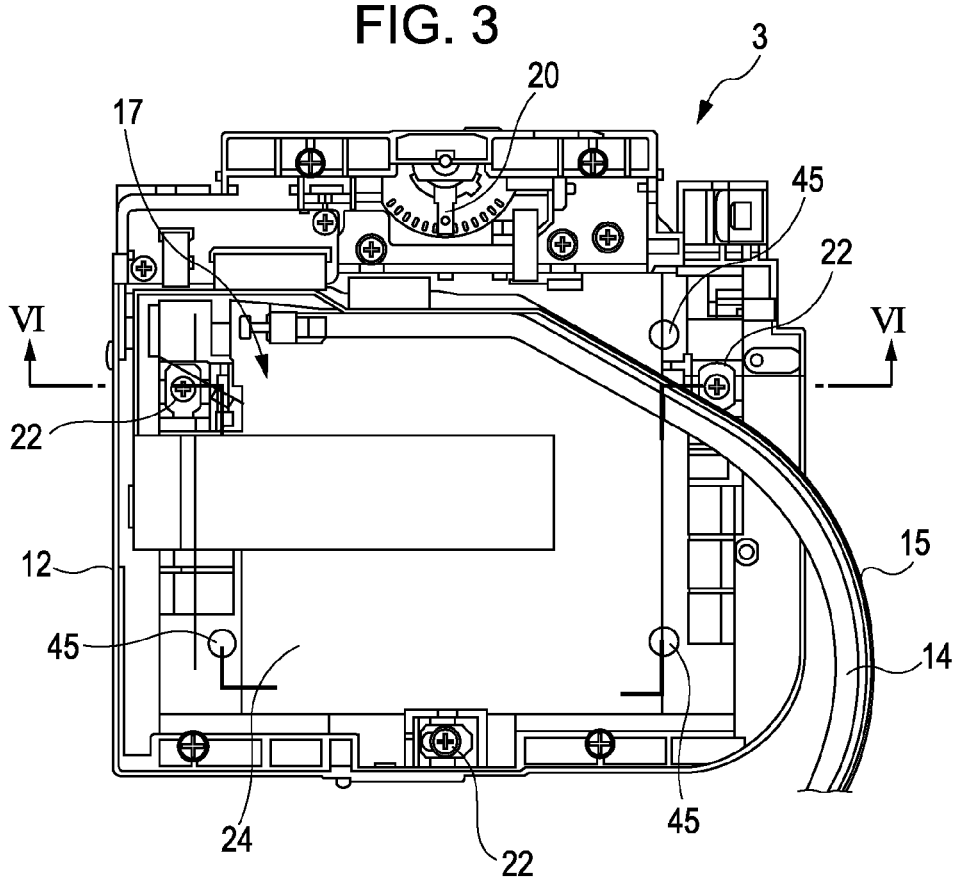
FIG. 3 is a top view of a carriage.
Figure 4:
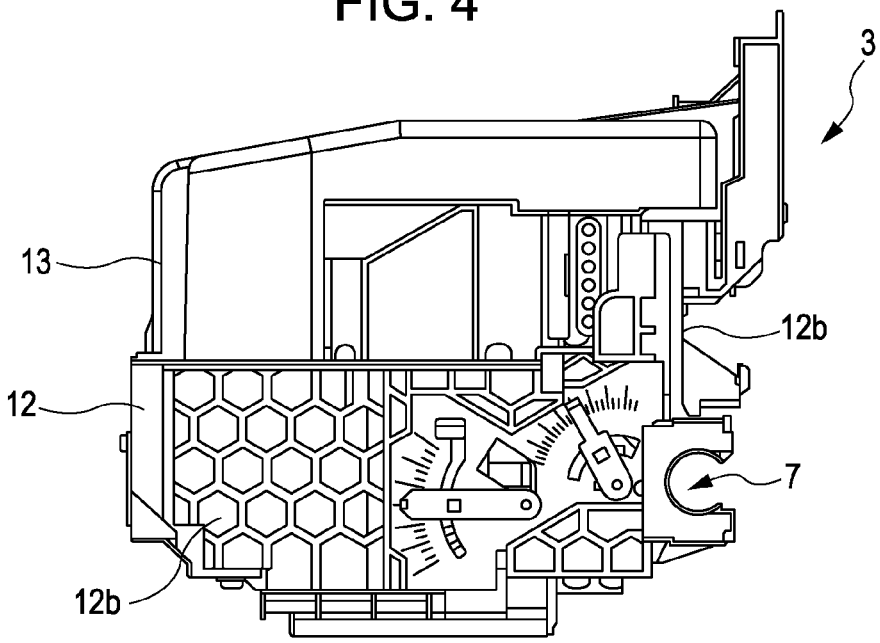
FIG. 4 is a right-side view of a carriage.
Figure 5:
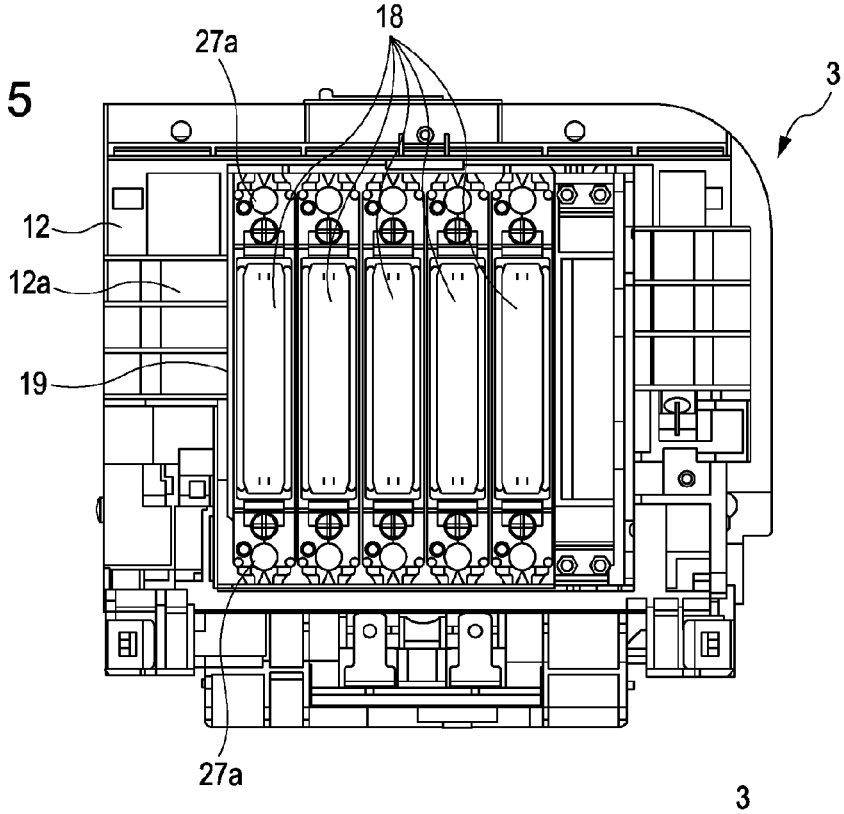
FIG. 5 is a bottom view of a carriage.
Figure 6:
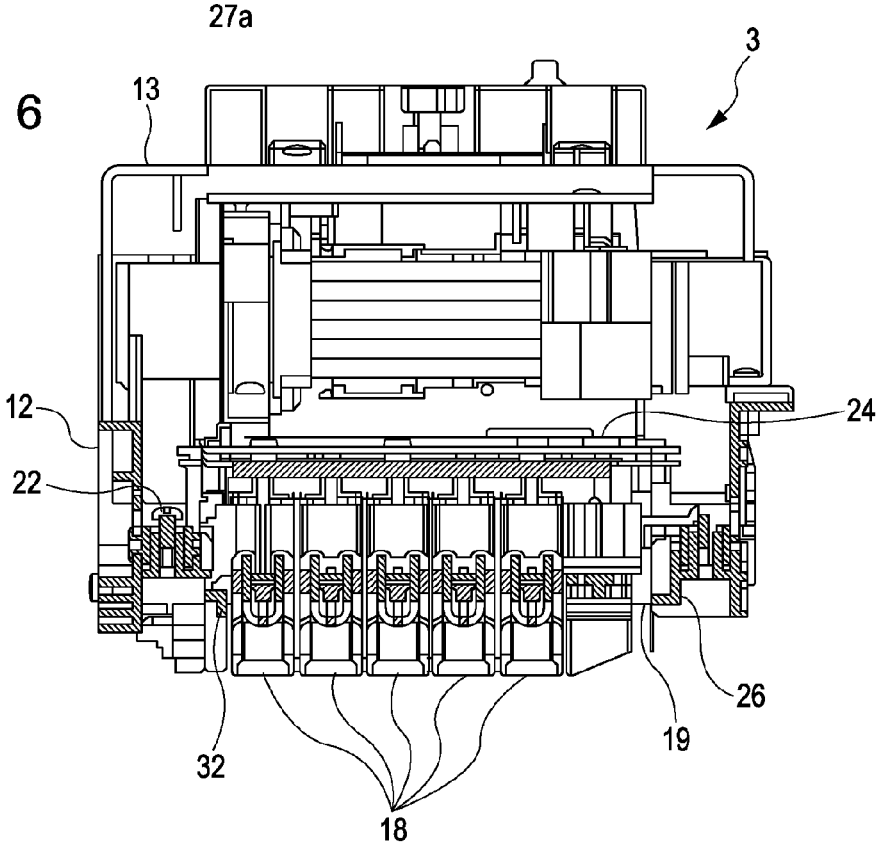
FIG. 6 is a cross-section viewed along the VI-VI line shown in FIG. 3.

FIG. 3 is a plan view (top view) of the carriage 3; FIG. 4 is a right-side view of the carriage 3; and FIG. 5 is a base view (bottom view) of the carriage 3. Meanwhile, FIG. 6 is a cross-section viewed along the VI-VI line shown in FIG. 3. Note that FIG. 3 illustrates a state in which a carriage cover 13 has been removed. The carriage 3 is configured of a main carriage unit 12 inside which the head unit 17 (a type of liquid ejecting head unit according to the invention), which will be discussed later, is installed, and the carriage cover 13 that covers an opening in the top of the main carriage unit 12; the carriage 3 is a hollow box-shaped member that can be split into top and bottom portions. The main carriage unit 12, in turn, is configured of an approximately rectangular-shaped base plate portion 12*a* and side wall portions 12*b* that protrude upward from each of the four side edges of the base plate portion 12*a*; the head unit 17 is housed within the space surrounded by the base plate portion 12*a* and the side wall portions 12*b*. A base portion opening 19 for exposing the nozzle formation surfaces 53 of the respective recording heads 18 in the head unit 17 housed in this manner is provided in the base plate portion 12*a*. When the head unit 17 is housed within the main carriage unit 12, the nozzle formation surfaces 53 of the recording heads 18 protrude downward (toward the recording medium when recording operations are being carried out), from the base portion opening 19 in the base plate portion 12*a*, beyond the base of the main carriage unit 12.

Figure 7A:
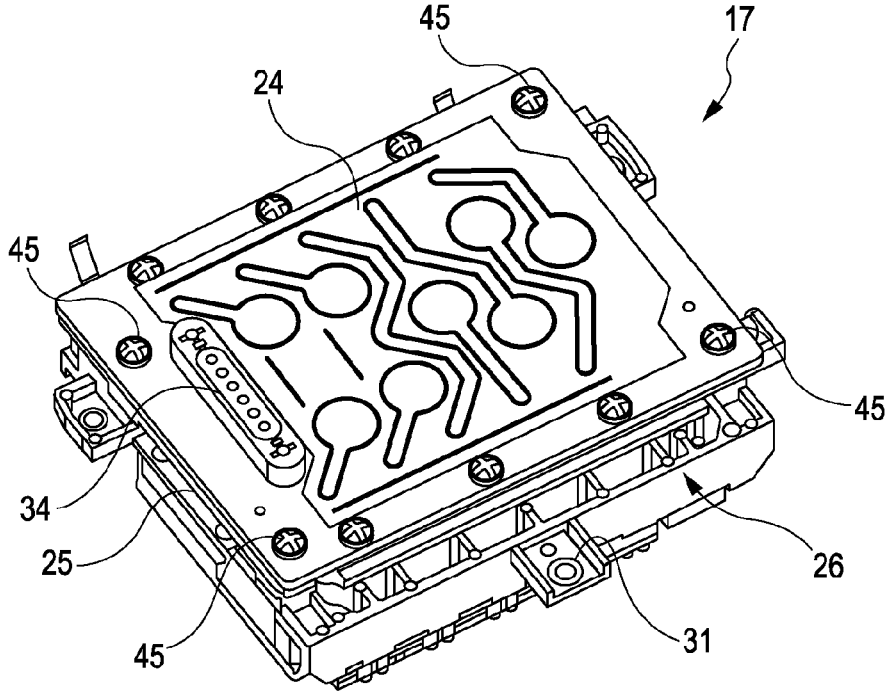
FIGS. 7A and 7B are perspective views of a head unit.
Figure 7B:
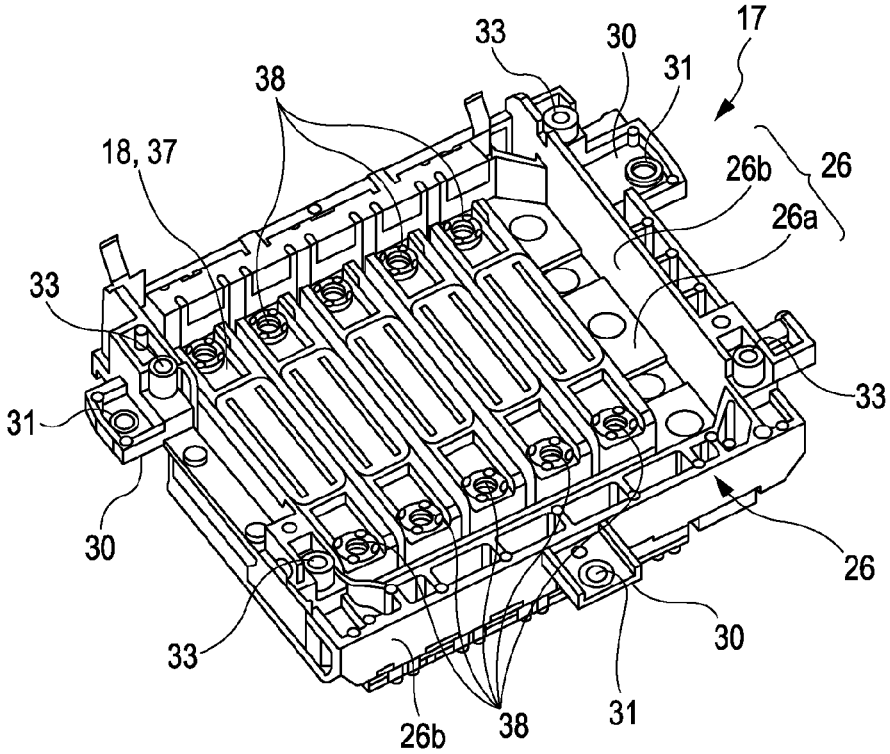
Figure 8:
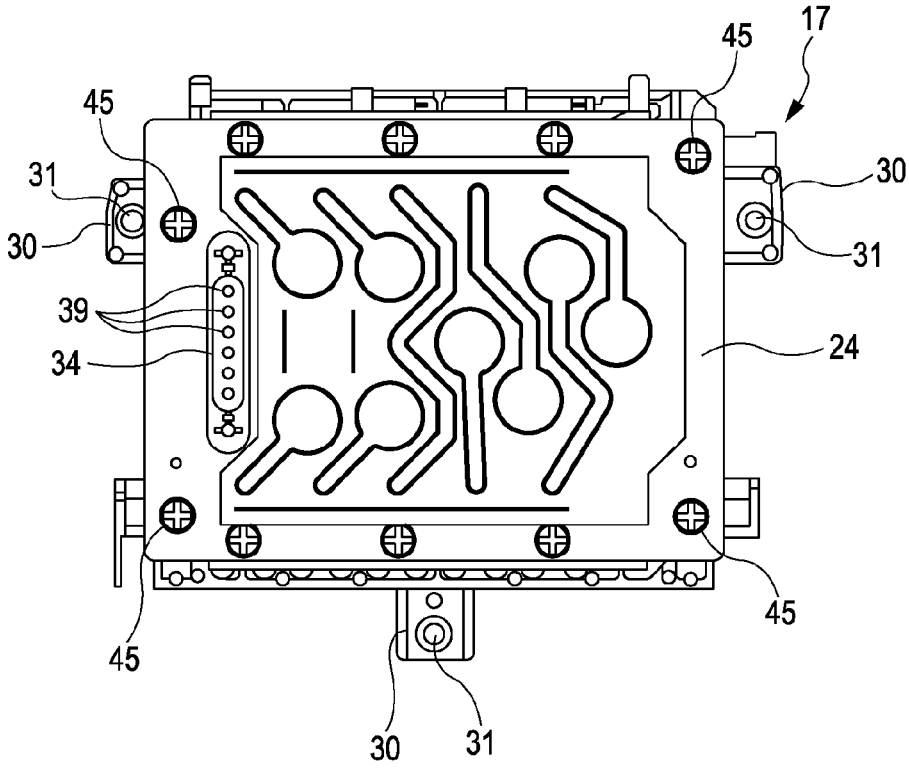
FIG. 8 is a top view of a head unit.
Figure 9:
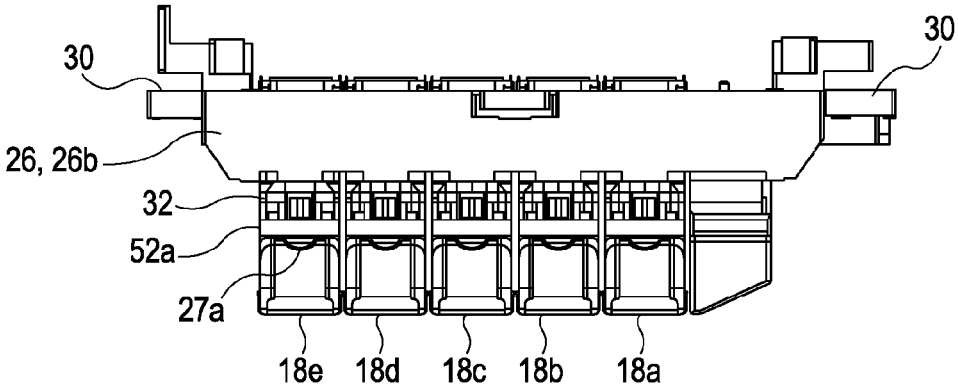
FIG. 9 is a front view of a head unit.
Figure 10:
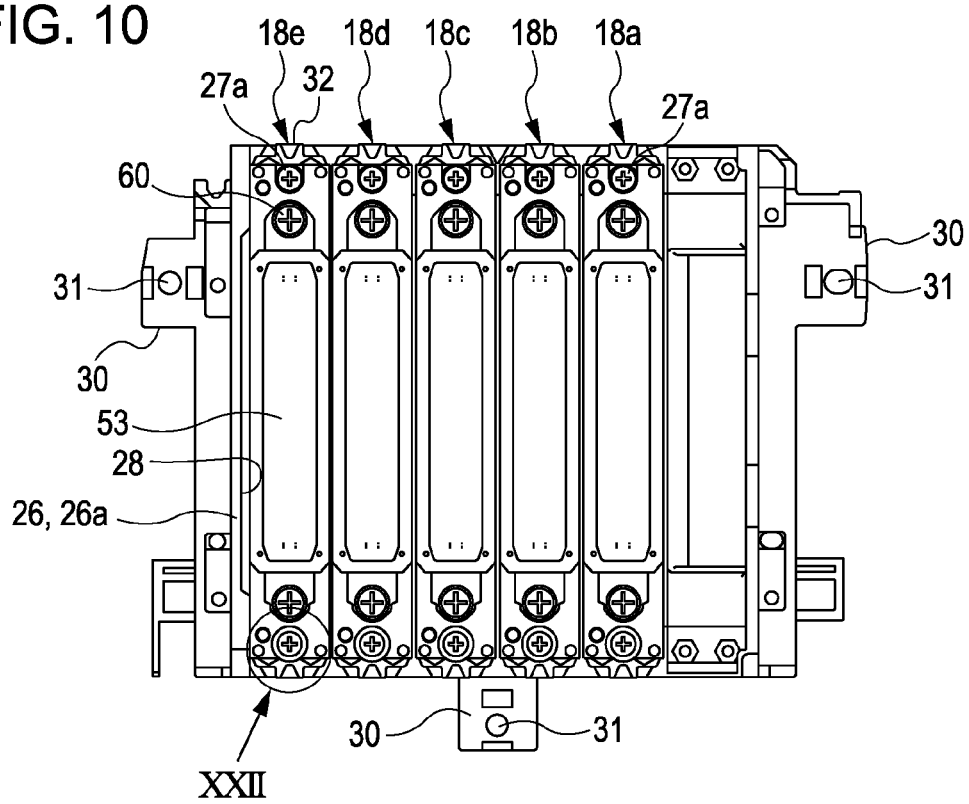
FIG. 10 is a bottom view of a head unit.
Figure 11:
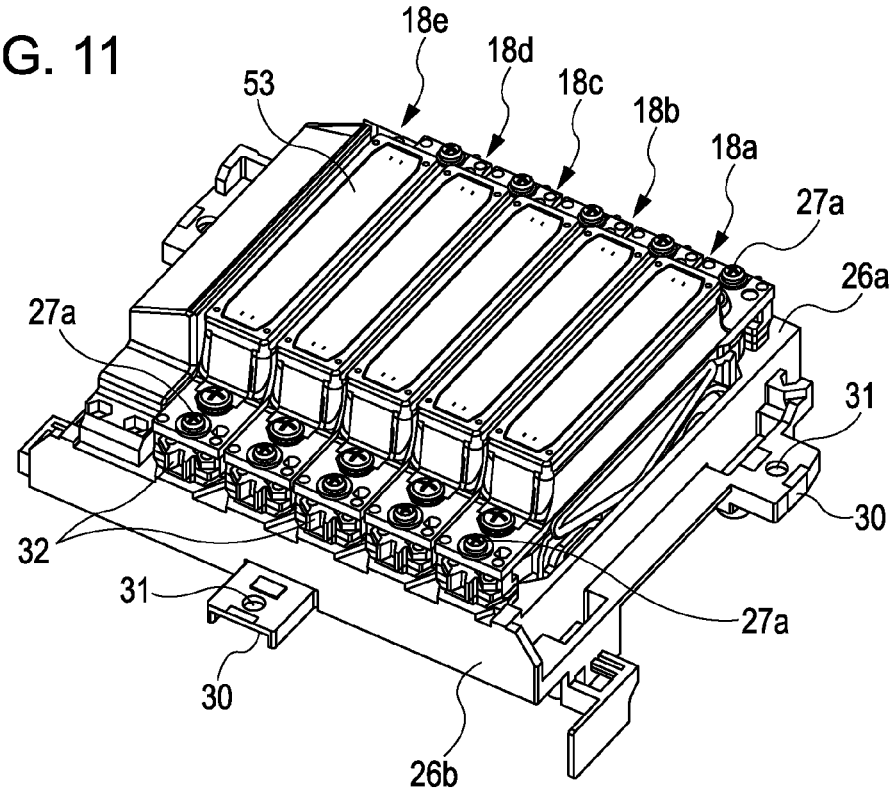
FIG. 11 is a perspective view of a head unit seen from the bottom.

FIGS. 7A and 7B are perspective views of the head unit 17, where FIG. 7A illustrates a state in which a flow channel member 24 is attached, and FIG. 7B illustrates a state in which the flow channel member 24 has been removed. In addition, FIG. 8 is a top view of the head unit 17; FIG. 9 is a front view of the head unit 17 (in a state in which the flow channel member 24 has been removed); FIG. 10 is a bottom view of the head unit 17; and FIG. 11 is a perspective view of the head unit 17 seen from below.

The head unit 17 integrates the plurality of recording heads 18 and so on as a single unit, and includes a sub-carriage 26 (a type of a head anchoring member according to the invention), to which the recording heads 18 are attached, and the flow channel member 24. The sub-carriage 26 is formed as a hollow box-shaped member whose upper surface is open, and includes a plate-shaped base portion 26*a* to which the recording heads 18 are anchored and four upright wall portions 26*b* that protrude upward from the four outer sides of the base portion 26*a*. The space surrounded by the base portion 26*a* and the four upright wall portions 26*b* functions as a housing portion that houses at least part of the recording heads 18 (mainly, sub-tanks 37). The sub-carriage 26 according to this embodiment is manufactured of a metal such as aluminum, and has a higher rigidity than the main carriage unit 12, the carriage cover 13, and so on. It is also possible to employ a synthetic resin as the material of the sub-carriage 26, instead of a metal.

A head communication opening 28 through which the plurality of recording heads 18 can pass (in other words, that is shared by the recording heads 18) is provided in what is the approximate center of the base portion 26*a* of the sub-carriage 26. Accordingly, the base portion 26*a* is a case-shaped frame member configured of four side portions. Fastening holes 29 (see FIG. 23) are provided in the bottom surface of the base portion 26*a* (on the side that opposes the recording medium during recording) in correspondence with the positions at which the recording heads 18 are attached. In this embodiment, the fastening holes 29 are provided at both sides in the direction that corresponds to the nozzle row direction (that is, the direction orthogonal to the direction in which the heads are arranged in a row), on either side of the head communication opening 28, at the locations in which each of the recording heads 18 are attached; the fastening holes 29 are provided in pairs at a total of four positions, in correspondence with sub-carriage insertion holes 69 in spacers 32, which will be discussed later.

In this embodiment, as shown in FIG. 10, a total of five recording heads 18, or a first recording head 18*a*, a second recording head 18*b*, a third recording head 18*c*, a fourth recording head 18*d*, and a fifth recording head 18*e*, are housed within the housing portion with the sub-tanks 37 (mentioned later) passing through from the bottom of the head communication opening 28, and are attached to the base portion 26*a* with respective spacers 32 between those recording heads 18 and the base portion 26*a* and so that the recording heads 18 are arranged side-by-side in the direction orthogonal to the nozzle rows.

As shown in FIGS. 7A, 7B, and 8, flange portions 30 are provided in three of the four upright wall portions 26*b* of the sub-carriage 26, so as to protrude to the side. Insertion holes 31 are provided in the flange portions 30, in correspondence with three attachment screw holes (not shown) provided at the positions for attaching the head unit 17 to the base plate portion 12*a* of the main carriage unit 12. The head unit 17 is housed within and anchored to the inside of the main carriage unit 12 by passing head unit anchoring screws 22 through the insertion holes 31 and fastening those screws into the attachment screw holes of the base plate portion 12*a* in the main carriage unit 12 in a state in which the attachment screw holes have each been positioned relative to their corresponding insertion holes 31. Furthermore, anchoring screw holes 33 for anchoring the flow channel member 24 are provided in the upper end surfaces of the four upright wall portions 26*b* of the sub-carriage 26, in a total of four locations.

The flow channel member 24 is a box-shaped member that is thin in the vertical direction, and is manufactured of, for example, a synthetic resin. Ink distribution channels (not shown) are formed, within the flow channel member 24, partitioned from each other for each of the colors of ink, in correspondence with respective flow channel connection portions 38 of the sub-tanks 37 (mentioned later) in the respective recording heads 18. A tube connection portion 34 is provided in the upper surface of the flow channel member 24 (that is, in the surface that is on the opposite side as the surface that is anchored to the sub-carriage 26). As shown in FIG. 8, a plurality of introduction openings 39 corresponding to the respective colors of ink are provided within this tube connection portion 34. The introduction openings 39 communicate with the ink distribution channels for the corresponding colors. When the stated ink supply tubes 14 are connected to the tube connection portion 34, ink supply channels for the respective colors within the ink supply tubes 14 communicate with the corresponding introduction openings 39 in a fluid-tight state. Through this, the ink of the respective colors that is transmitted from the ink cartridge through the ink supply tubes 14 is introduced into the respective ink distribution channels within the flow channel member 24 via the introduction openings 39. Furthermore, connection flow channels (not shown) are provided in the bottom surface of the flow channel member 24, in positions corresponding to the flow channel connection portions 38 of the sub-tanks 37 in the respective recording heads 18. Each of the connection flow channels are configured so as to be inserted into corresponding flow channel connection portions 38 of the sub-tanks 37 in the recording heads 18, and to link therewith in a fluid-tight state. Further still, flow channel insertion holes (not shown) corresponding to the anchoring screw holes 33 in the sub-carriage 26 are formed in the four corners of the flow channel member 24, so as to pass through in the thickness direction of the plate. When the flow channel member 24 is anchored to the sub-carriage 26, flow channel anchoring screws 45 are passed through the flow channel insertion holes and are fastened (threaded) into the anchoring screw holes 33. The ink that has passed through the ink distribution channels within the flow channel member 24 is supplied to the sub-tanks 37 of the recording heads 18 via the connection flow channels and the flow channel connection portions 38.

Figure 12:
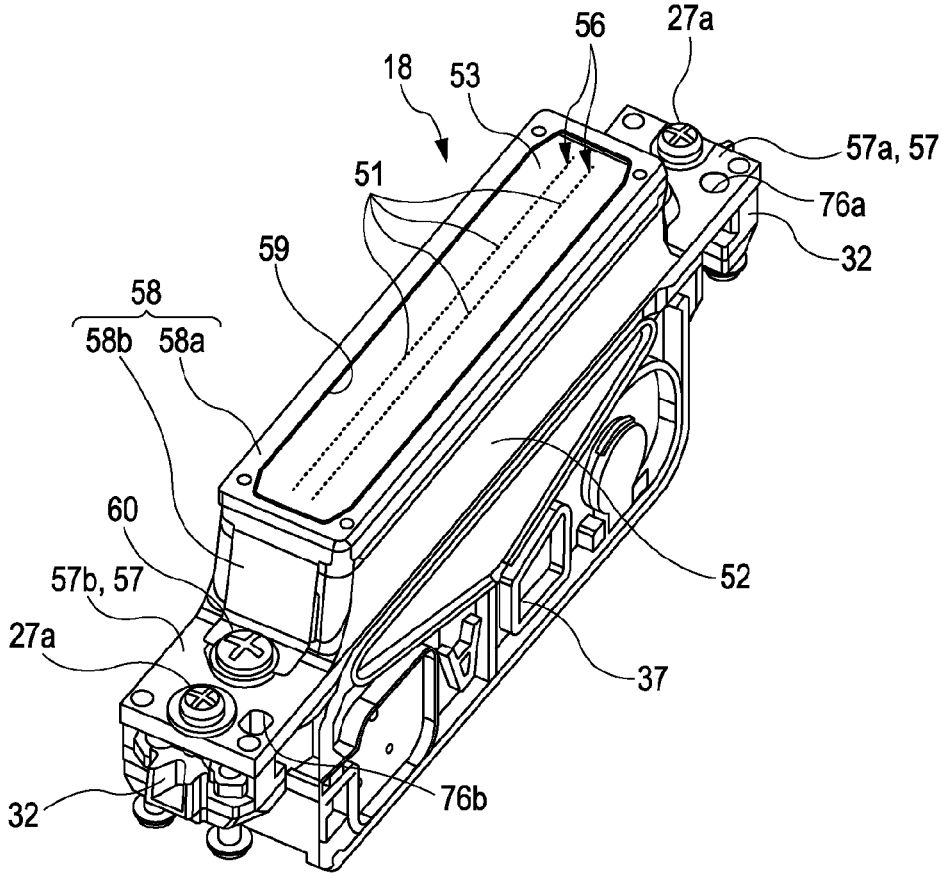
FIG. 12 is a perspective view illustrating the configuration of a recording head.
Figure 13A:
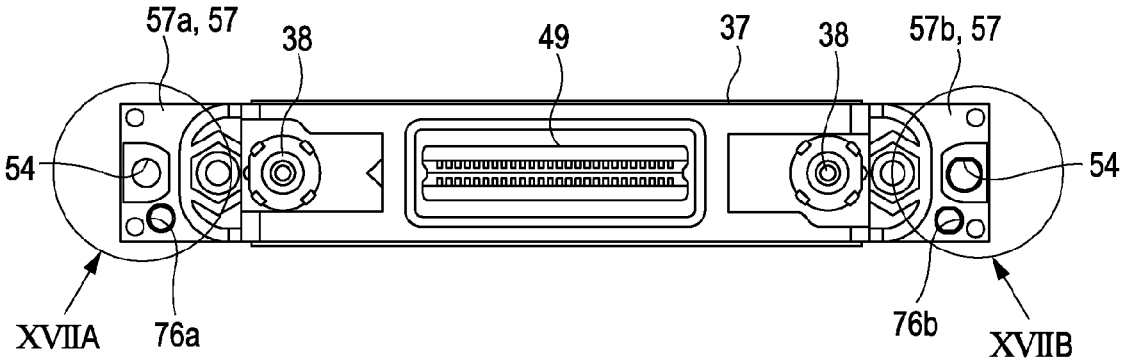
FIGS. 13A and 13B are top views illustrating the configuration of a recording head.
Figure 13B:
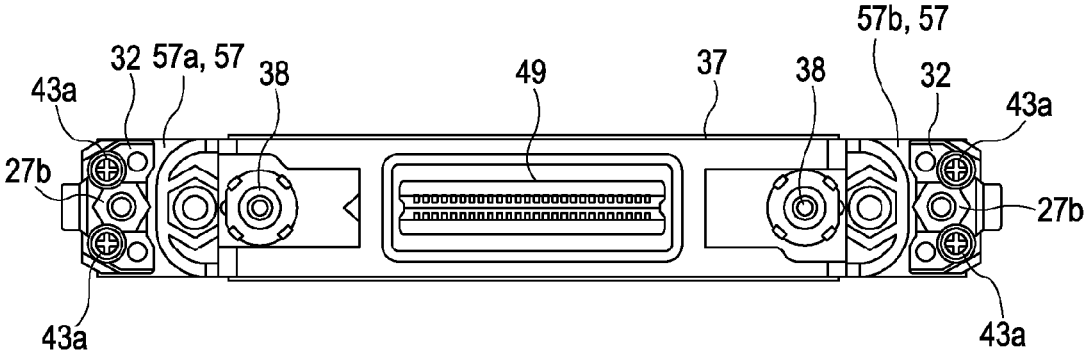
Figure 14A:
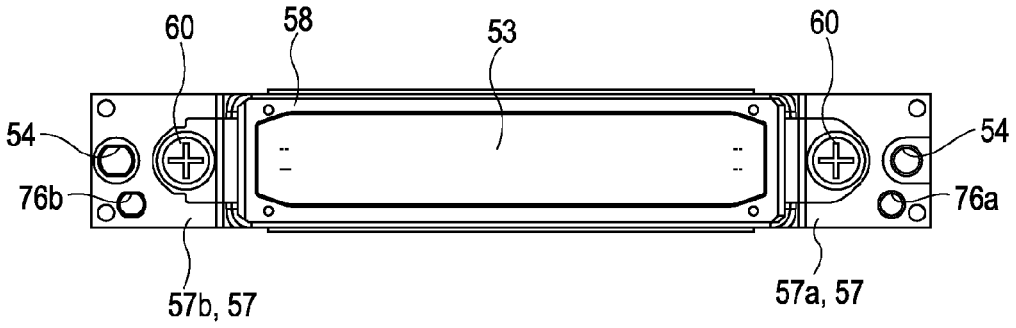
FIGS. 14A and 14B are bottom views illustrating the configuration of a recording head.
Figure 14B:
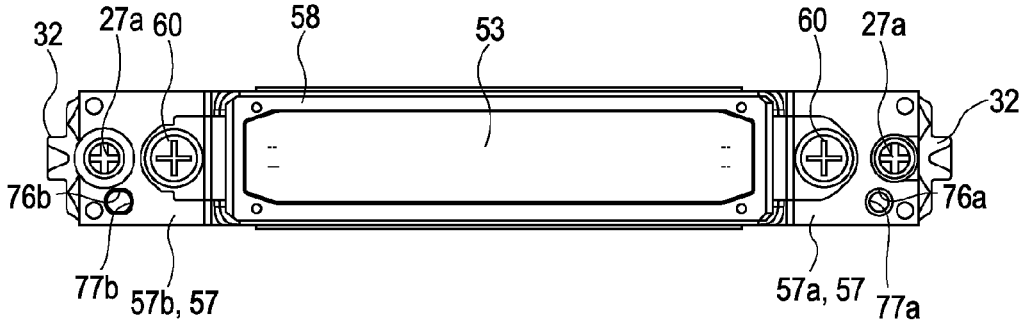
Figure 15A:
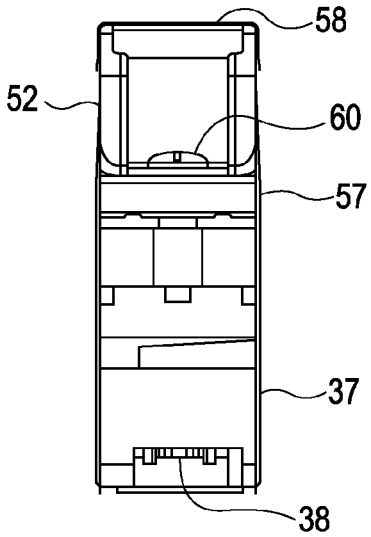
FIGS. 15A and 15B are front views illustrating the configuration of a recording head.
Figure 15B:
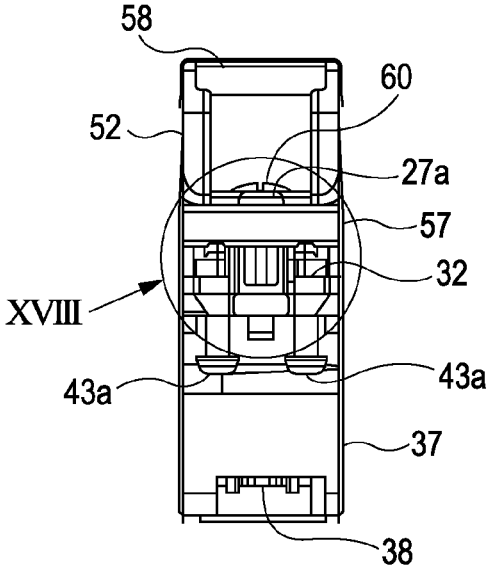
Figure 16A:
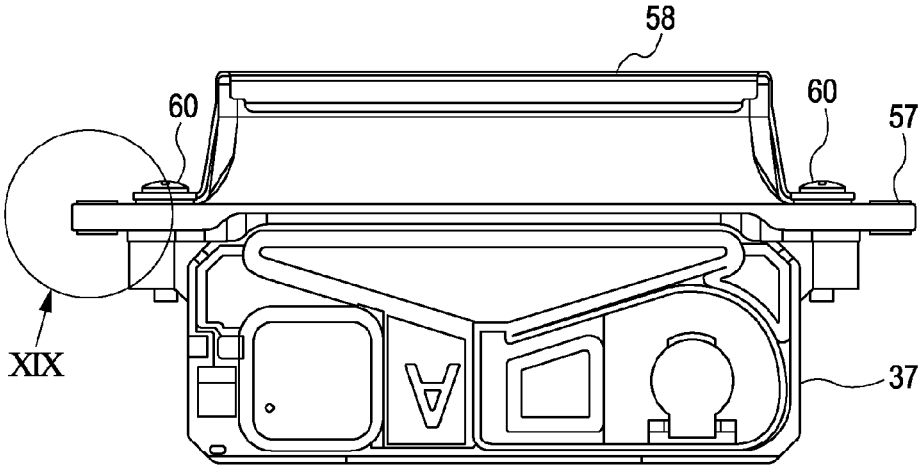
FIGS. 16A and 16B are right-side views illustrating the configuration of a recording head.
Figure 16B:
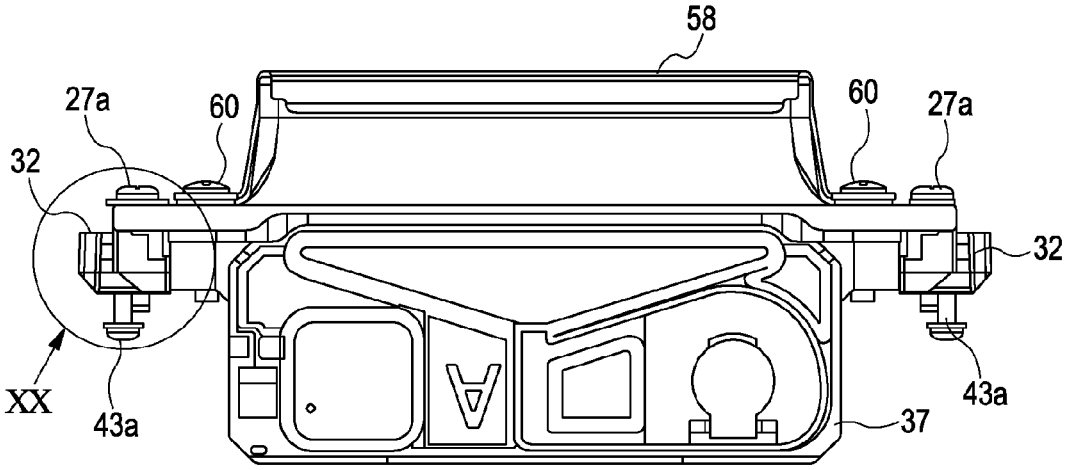

FIG. 12 is a perspective view illustrating the configuration of the recording heads 18 (a type of liquid ejecting head). FIGS. 13A and 13B are top views of one of the recording heads 18, where FIG. 13A illustrates a state in which the spacers 32 are not attached and FIG. 13B illustrates a state in which the spacers 32 are attached. FIGS. 14A and 14B are bottom views of one of the recording heads 18, where FIG. 14A illustrates a state in which the spacers 32 are not attached and FIG. 14B illustrates a state in which the spacers 32 are attached. FIGS. 15A and 15B are front views of one of the recording heads 18, where FIG. 15A illustrates a state in which the spacers 32 are not attached and FIG. 15B illustrates a state in which the spacers 32 are attached. FIGS. 16A and 16B are right-side views of one of the recording heads 18, where FIG. 16A illustrates a state in which the spacers 32 are not attached and FIG. 16B illustrates a state in which the spacers 32 are attached.

Figure 17A:
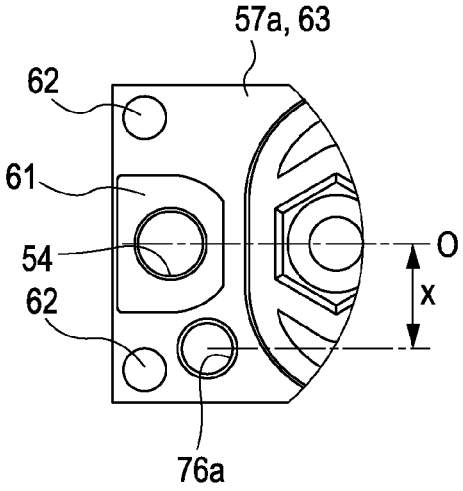
FIG. 17A is an enlarged view of the region XVIIA illustrated in FIG. 13A.
Figure 17B:
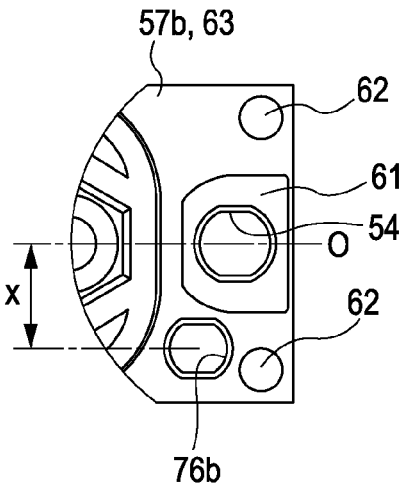
FIG. 17B is an enlarged view of the region XVIIB illustrated in FIG. 13A.
Figure 18:
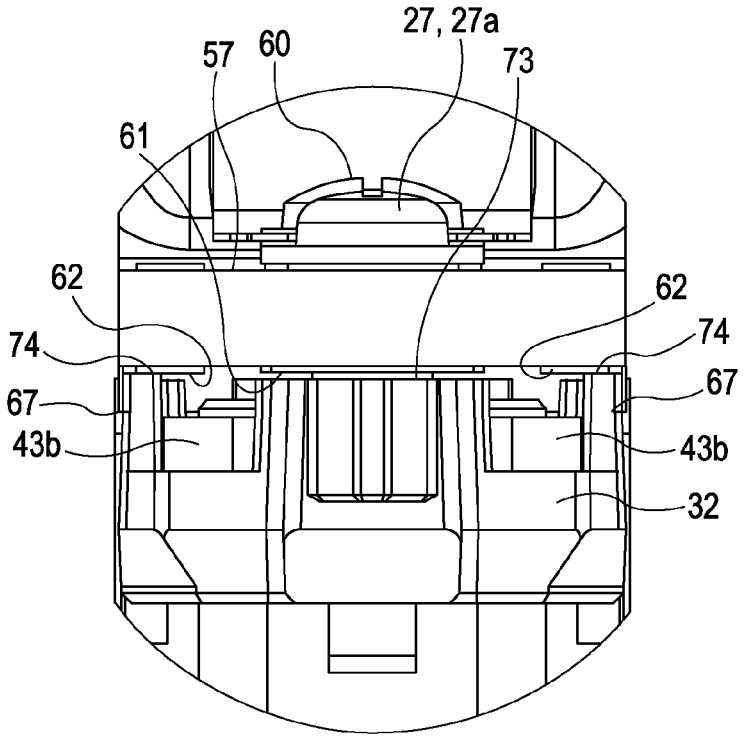
FIG. 18 is an enlarged view of the region XVIII shown in FIG. 15B.
Figure 19:
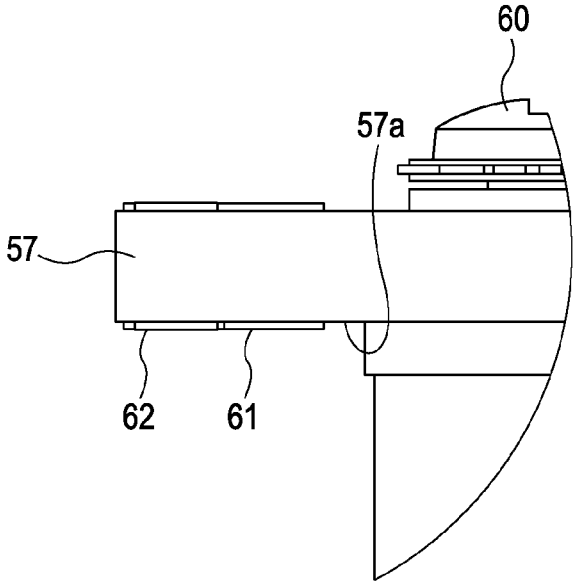
FIG. 19 is an enlarged view of the region XIX shown in FIG. 16A.
Figure 20:
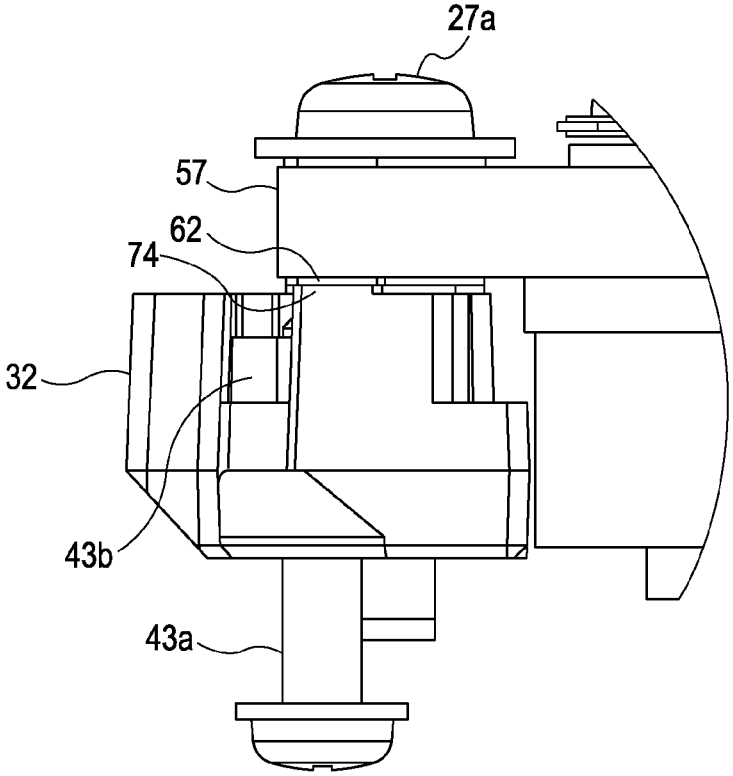
FIG. 20 is an enlarged view of the region XX shown in FIG. 16B.

FIG. 17A is an enlarged view of the region XVIIA illustrated in FIG. 13A, and FIG. 17B is an enlarged view of the region XVIIB illustrated in FIG. 13A. FIG. 18 is an enlarged view of the region XVIII illustrated in FIG. 15B, and FIG. 19 is an enlarged view of the region XIX illustrated in FIG. 16A. Finally, FIG. 20 is an enlarged view of the region XX shown in FIG. 16B. Note that the basic structure and so on each of the recording heads 18 is the same, and thus only one of the five recording heads 18 attached to the sub-carriage 26 will be described as a representative example.

The recording head 18 includes, in a head case 52, a flow channel unit that forms an ink flow channel including a pressure chamber that communicates with nozzles 51, a pressure generation unit such as a piezoelectric vibrator or a thermal element that causes fluctuations in the pressure of the ink within the pressure chamber, and so on (these units are not shown). The recording head 18 according to this embodiment is formed so that, when viewed from above, the recording head 18 is longer in the nozzle row direction and shorter in the width direction that is orthogonal to the nozzle rows. This recording head 18 is configured so as to carry out recording operations, in which ink is ejected through the nozzles 51 and caused to land upon a recording medium such as recording paper, by a driving signal from the control unit of the printer 1 being applied to the pressure generation unit and driving the pressure generation unit. Nozzle rows 56, in which a plurality of nozzles 51 that eject ink are arranged in rows, are configured in the nozzle formation surface 53 of each of the recording heads 18, and two such nozzle rows 56 are formed side-by-side in the direction orthogonal to those nozzle rows. A single nozzle row 56 is configured of 360 nozzles disposed at a pitch of, for example, 360 dpi.

The head case 52 is a hollow box-shaped member and serves as a type of main head unit according to the invention. The flow channel unit is anchored to the leading end of the head case 52 with the nozzle formation surface 53 exposed. In addition, the pressure generation unit and the like are housed within a housing space formed inside the head case 52, and the sub-tanks 37 for supplying ink to the flow channel unit are mounted on the base end side (upper surface side) of the head case 52, which is on the opposite side as the leading end. Furthermore, flange portions 57 (corresponding to an intermediate member anchoring portion according to the invention) that protrude toward the side are formed in the upper surface side of the head case 52, and are formed on both sides in the nozzle row direction. As shown in FIGS. 17A and 17B, spacer attachment holes 54 (corresponding to intermediate member attachment holes according to the invention) are provided in the respective flange portions 57 in correspondence with head insertion holes 68 of the spacers 32. When the spacers 32 are attached to the flange portions 57 on both sides, the shaft portions of spacer anchoring bolts 27*a* are inserted through these spacer attachment holes 54.

The spacer attachment holes 54 are formed in the flange portions 57 in the center thereof in the flange width direction, which is the direction orthogonal to the direction in which the two flange portions 57 are arranged (that is, the direction orthogonal to the direction in which the areas for linking to the spacers 32 are arranged relative to each other, or the direction orthogonal to the nozzle rows), and are formed so as to pass through the flange portions 57 in the thickness direction thereof. One of the spacer attachment holes 54 in the two flange portions (the spacer attachment hole 54 on the left side, in FIG. 13A) is a through-hole that has a circular shape when viewed from above, as shown in FIG. 17A, and the inner diameter thereof is set to be slightly greater than the outer diameter of the shaft portion of the spacer anchoring bolt 27*a*. Accordingly, this configuration not only makes it possible to insert the shaft portion of the spacer anchoring bolt 27*a* into this one spacer attachment hole 54 in a smooth manner, but also makes it difficult for looseness to arise between the two. On the other hand, the other spacer attachment hole 54 (that is, the spacer attachment hole 54 on the right side in FIG. 13A) is, as seen from above in FIG. 17B, an oblong hole that is longer in the direction in which the spacer attachment holes 54 are arranged (that is, the nozzle row direction). The inner diameter of this other spacer attachment hole 54 in the attachment hole arrangement direction (that is, the long-side diameter) is set so as to be greater than the outer diameter of the shaft portion of the spacer anchoring bolt 27*a*, whereas the inner diameter in the flange width direction, which is orthogonal to the attachment hole arrangement direction (that is, the short-side diameter), is the same as the inner diameter of the one spacer attachment hole 54. In this manner, one of the spacer attachment holes 54 in the two flange portions 57 is a round hole, while the other is an oblong hole, which, when the spacers 32 anchored to the flange portions 57 are screwed down onto the head attachment portions of the sub-carriage 26, allows for error between the intervals of the fastening holes 29 in the sub-carriage 26 and the intervals of the spacer attachment holes 54 within the range of the long-side diameter of the oblong hole.

Opening edge portions 61 of the spacer attachment holes 54 protrude toward the spacers 32, beyond spacer anchoring surfaces 63 (intermediate member anchoring services) of the flange portions 57, when the spacers 32 are in an attached state. These opening edge portions 61 are embankment-shaped protrusions formed so as to enclose the periphery of the spacer attachment holes 54. Furthermore, contact projections 62, which are circular when viewed from above, are formed in the spacer anchoring surfaces 63 in the flange portions 57, on both sides further outward from the spacer attachment holes 54 in the flange width direction. In this embodiment, the contact projections 62 are provided in the respective outside corner areas of both of the flange portions 57. These contact projections 62 protrude toward the spacers 32, beyond the spacer anchoring surfaces 63 of the flange portions 57, when the spacers 32 are in an attached state.

Furthermore, a round hole 76*a* (corresponding to a head-side positioning hole according to the invention) that serves as a reference for positioning relative to the spacer 32 is provided, in one of the spacer anchoring surfaces 63 of both the flange portions 57, or a flange portion 57*a* (on the left side in FIG. 13A), so as to correspond to a positioning hole 77*a* of the spacer 32 (mentioned later). Likewise, an oblong hole 76*b* (corresponding to a head-side positioning hole according to the invention) that serves as a reference for positioning relative to the spacer 32 is provided, in the other flange portion 57*b* (on the right side in FIG. 13A), so as to correspond to a positioning hole 77*b* of the spacer 32.

As shown in FIG. 17A, the round hole 76*a* is provided in a position in the flange portion 57*a* that does not interfere with the spacer attachment hole 54, the opening edge portions 61, and the contact projections 62 and a position that is distanced more toward one side (in FIG. 17A, toward the lower side) than a center line in the flange width direction (indicated by the reference numeral O in FIG. 17A), and is provided so as to pass through the flange portion 57*a* in the thickness direction thereof. This round hole 76*a* is a through-hole that has a circular opening when viewed from above, and the inner diameter thereof is set to be slightly greater than the outer diameter of a positioning pin 80 in a positioning tool 79, which will be mentioned later. Meanwhile, as shown in FIG. 17B, the oblong hole 76*b* is provided in a position that does not interfere with the spacer attachment hole 54, the opening edge portions 61, and the contact projections 62 and a position that is distanced more toward one side (in FIG. 17B, toward the lower side) than the center line in the flange width direction (indicated by the reference numeral O in FIG. 17B), and is provided so as to pass through the flange portion 57*a* in the thickness direction thereof. This oblong hole 76*b* is a through-hole that has, when viewed from above, an oblong opening that is longer in the direction in which the positioning holes are arranged. The inner diameter of this oblong hole 76*b* in the direction in which the positioning holes are arranged (that is, the long-side diameter) is set to be sufficiently greater than the outer diameter of the positioning pin 80 in the positioning tool 79, whereas the inner diameter (that is, the short-side diameter) in the flange width direction is the same as the inner diameter of the round hole 76*a*. Note that the positioning of the spacers 32 relative to the flange portions 57 by the positioning tool 79 will be discussed later.

In this embodiment, the round hole 76*a* and the oblong hole 76*b* are provided in positions that are distanced from the center line O in the flange width direction by the same amount to one side (toward the bottom, in FIGS. 17A and 17B) in the flange width direction (this distance is indicated by the reference numeral x in FIGS. 17A and 17B). In other words, the distance of the round hole 76*a* from the center line O in the flange width direction and the distance of the oblong hole 76*b* from the center line O in the flange width direction are set so as to be the same. To rephrase, the round hole 76*a* and the oblong hole 76*b* are formed so as to be arranged in parallel in the nozzle row direction. Accordingly, it is easy to manage the positions of the nozzle rows using the round hole 76*a* and the oblong hole 76*b* as reference axes.

A cover member 58 that protects the edge portions of the flow channel unit, the nozzle formation surface 53, and so on from making contact with the recording paper or the like is attached to the leading end surface side of the head case 52. This cover member 58 is manufactured of a thin metal plate that is conductive, such as stainless steel or the like. The cover member 58 according to this embodiment is generally configured of an approximately frame-shaped frame portion 58*a* in the central area of which an opening window portion 59 is provided, and side plate portions 58*b* that extend along the side surfaces of the head case 52 from the edge portions on both sides of the frame portion 58*a* in the nozzle row direction when attached to the head case 52. The leading ends of the side plate portions 58*b* are bent outwards so as to achieve a shape that follows the flange portions 57, and are screwed down onto the flange portions 57 using cover affixing screws 60. In addition to protecting the edges of the flow channel unit, the nozzle formation surface 53, and so on, this cover member 58 also functions so as to adjust the nozzle formation surface 53 to a ground potential.

The aforementioned sub-tanks 37 are members for introducing the ink from the flow channel member 24 into the pressure chambers of the recording heads 18. The sub-tanks 37 have a self-sealing function that controls the introduction of ink into the pressure chambers by opening and closing a valve based on internal pressure fluctuations. The flow channel connection portions 38 that connect to the connection flow channels of the stated flow channel member 24 are provided on both ends of the following end (upper surface) of the sub-tanks 37 in the nozzle row direction. Ring-shaped gaskets (not shown) are embedded in the flow channel connection portions 38, and the fluid-tight state of the flow channel member 24 is maintained by these gaskets. In addition, driving boards (not shown) for supplying driving signals to the pressure generation units are provided within the sub-tanks 37. Furthermore, connectors 49 for electrically connecting the driving boards to flexible cables (a type of wiring member; not shown) are disposed within openings in the central areas of the following end surfaces of the sub-tanks 37.

Figure 21A:
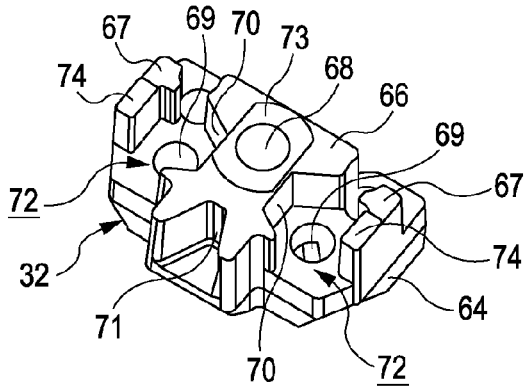
FIGS. 21A through 21E are diagrams illustrating the configuration of a spacer.
Figure 21B:
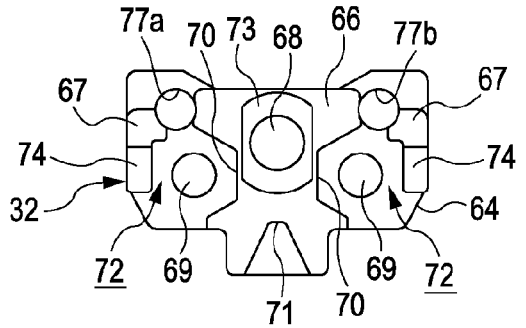
Figure 21C:
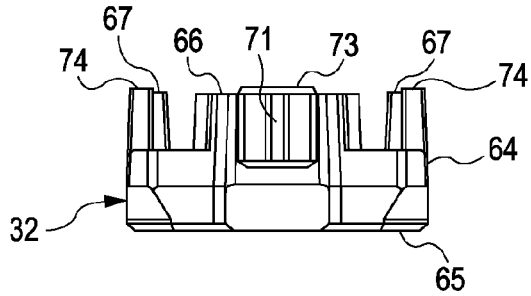
Figure 21D:
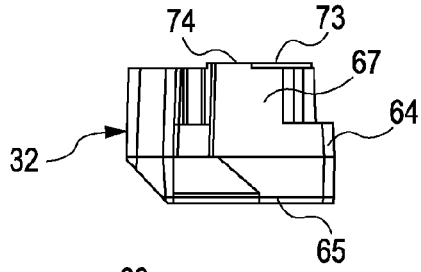
Figure 21E:
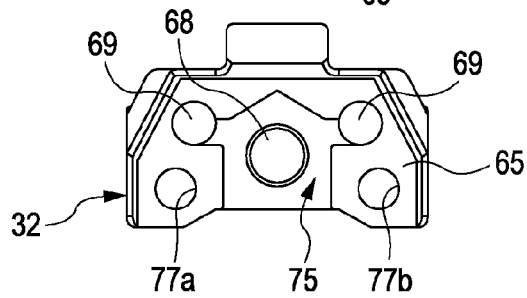
Figure 22:
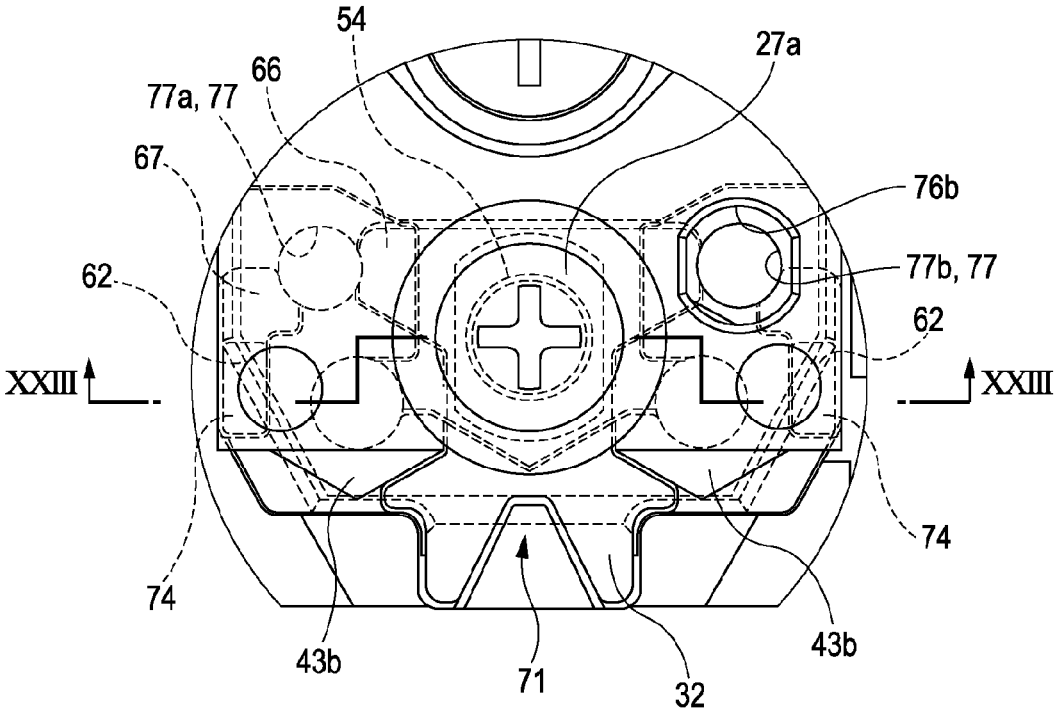
FIG. 22 is an enlarged view of a spacer anchoring area in a flange portion.
Figure 23:
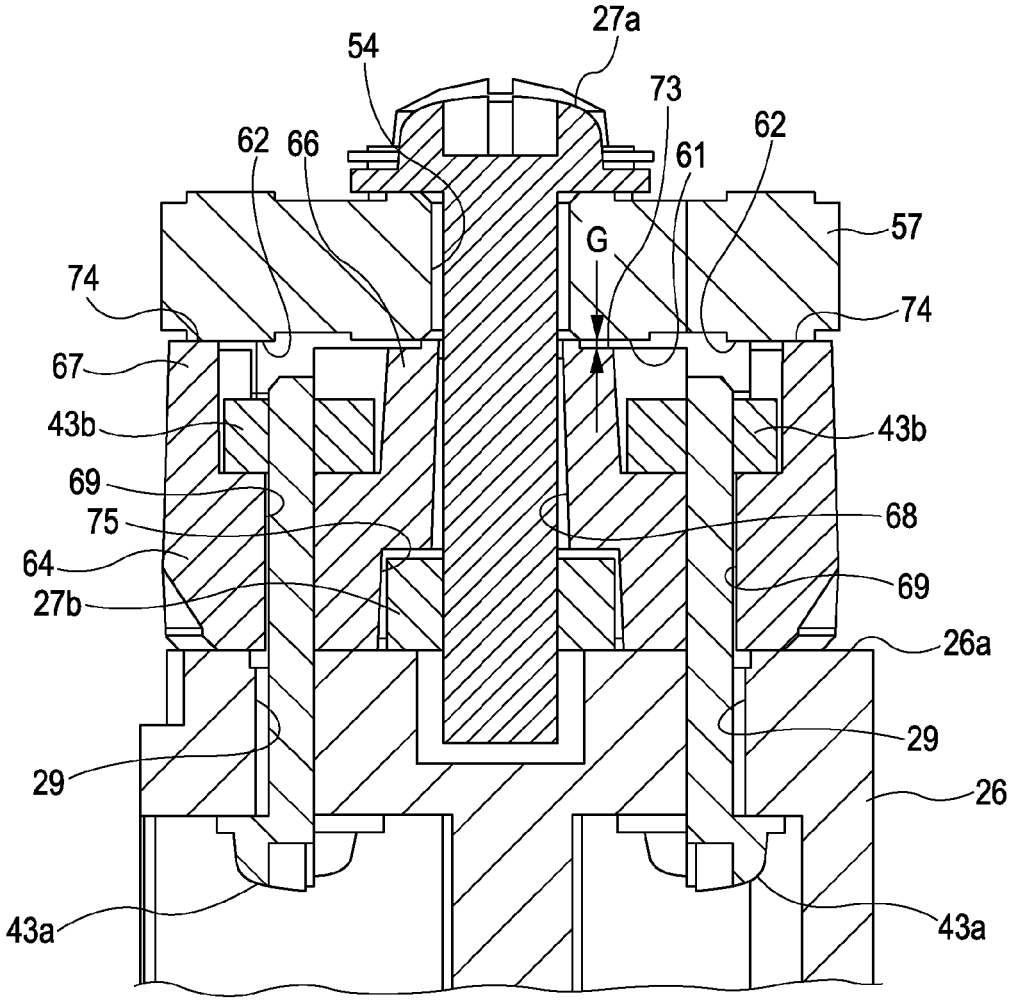
FIG. 23 is a cross-section viewed along the XXIII-XXIII line shown in FIG. 22.

FIGS. 21A through 21E are diagrams illustrating the configuration of the spacer 32 (a type of intermediate member), where FIG. 21A is a perspective view, FIG. 21B is a top view, FIG. 21C is a front view, FIG. 21D is a right-side view, and FIG. 21E is a bottom view. FIG. 22 is an enlarged plan view illustrating the position at which the spacer 32 is attached to the flange portion 57 (that is, an enlarged view of the region x shown in FIG. 10), whereas FIG. 23 is a cross-section viewed along the XXIII-XXIII line shown in FIG. 22.

The spacers 32 according to this embodiment are members configured of a synthetic resin, and a total of two are attached, one each on the spacer anchoring surfaces 63 of the flange portions 57 (the surfaces facing the sub-tanks 37) on both sides of a single recording head 18. The spacers 32 have the same shape. The recording head 18 is attached to the base portion 26*a* of the sub-carriage 26 with the spacers 32 therebetween. Accordingly, the spacers 32 are members that regulates the position of the recording head 18 relative to the base portion 26*a* of the sub-carriage 26 in the height direction (that is, the direction that is vertical relative to the nozzle formation surface). Therefore, a high degree of precision is required with respect to the dimension from a base surface 65 of the spacer 32 to the leading end surface of a contact protrusion 74, which will be mentioned later.

Each of the spacers 32 is generally configured of: a main spacer unit 64 that includes the base surface 65, which is disposed on the base portion 26*a* of the sub-carriage 26; a central boss portion 66 that is formed in the center of the main spacer unit 64 in the width direction thereof (this corresponds to the flange width direction when the spacer 32 is attached to the flange portion 57); and side wall portions 67 that are formed at a distance from each other on both sides of the central boss portion 66 in the width direction. When viewed from above, the dimension of the spacer 32 in the width direction is essentially the same as the dimension of the flange portion 57 in the width direction. Meanwhile, when the spacer 32 is correctly attached to the flange portion 57, part of the central boss portion 66 (mentioned later) protrudes slightly more to the side than the end surface of the flange portion 57 that protrudes.

The central boss portion 66 rises up from the main spacer unit 64 in the direction that is to the side of the flange portion 57 when the spacer 32 is attached. Cutouts that have a three-sided shape when viewed from above, following the shape of head anchoring nuts 43*b* (see FIG. 22), are provided in the side surfaces of the central boss portion 66 on both sides in the width direction. These cutouts are head anchoring nut cutouts 70 that serve as the inner wall surfaces of the side wall portions 67 and that regulate the orientation in the planar direction of the head anchoring nuts 43*b* (that is, the rotation thereof when those nuts are screwed down). In other words, head anchoring nut housing portions 72, which house the head anchoring nuts 43*b*, are formed by the main spacer unit 64, the nut cutouts 70, and the side wall portions 67. The head anchoring nuts 43*b* are embedded in the head anchoring nut housing portions 72 prior to the spacer 32 being anchored to the flange portion 57.

One of the areas in the depth direction of the central boss portion 66 (that is, the side that is on the opposite side as the sub-tank 37 when attached to the flange portion 57) protrudes from the main spacer unit 64 toward the side. A tool cutout 71, which has an approximately triangular shape when viewed from above, is formed in this protruding portion, so as to gradually become narrower from one side in the depth direction to the other side in the depth direction. A tool for holding the head is fitted into this tool cutout 71 when the recording head 18 is positioned at the head attachment area of the sub-carriage 26.

The head insertion holes 68 are provided in the central area of the central boss portion 66 in the width direction thereof, in correspondence with the spacer attachment holes 54 of the flange portion 57 in the recording head 18. As shown in FIG. 21B, these head insertion holes 68 are through-holes that are round in shape when viewed from above. The inner diameter of these head insertion holes 68 is set to be slightly greater than the outer diameter of the shaft portions of the spacer anchoring bolts 27*a*, and is the same as the inner diameter of the spacer attachment holes 54. Insertion hole edge portions 73 of the head insertion holes 68 protrude toward the flange portion 57, when attached, beyond the protruding end surface of the central boss portion 66. These insertion hole edge portions 73 are embankment-shaped protrusions that enclose the periphery of the openings of the head insertion hole 68 when viewed from above, and are provided in positions that correspond to the opening edge portions 61 of the flange portion 57.

The sub-carriage insertion holes 69 are provided, in the head anchoring nut housing portions 72 that are in turn provided in both sides of the central boss portion 66, in correspondence with the fastening holes 29 provided in the base portion 26*a* of the sub-carriage 26. The sub-carriage insertion holes 69 are through-holes that are, as shown in FIG. 21B, round in shape when viewed from above, and the inner diameter thereof is set to be slightly greater than the outer diameter of the shaft portions of head anchoring bolts 43*a*. Accordingly, the sub-carriage insertion holes 69 are configured so that it is not only possible to insert the shaft portions of the head anchoring bolts 43*a* in a smooth manner, but it is difficult for looseness to arise between the two. In this manner, one head insertion hole 68 and two sub-carriage insertion holes 69 are provided in each of the spacers 32. In other words, the areas where the spacer 32 and the sub-carriage 26 are screwed to each other using the head anchoring bolts 43*a* and the head anchoring nuts 43*b* are further outside in the width direction than the areas where the spacer 32 and the flange portion 57 are screwed to each other.

The side wall portions 67 provided on both sides of the spacer 32 in the width direction are walls that protrude from the main spacer unit 64 toward the flange portion 57 in an attached state, and are formed so as to be continuous from both sides of the main spacer unit 64 in the width direction. The end surfaces of these projecting side wall portions 67 are flush with the end surface of the projecting central boss portion 66. In addition, contact protrusion portions 74 are protrudingly provided in the projecting side surface of the side wall portions 67 toward the side of flange portion 57 in the attached state from the side surface. These contact protrusions 74 are provided in locations that can make contact with the contact protrusion portions 62 when the spacer 32 is correctly attached to the flange portion 57 (that is, when those two elements are screwed to each other using the spacer anchoring bolts 27*a* and the spacer anchoring nuts 27*b*). The leading end surfaces of these contact protrusions 74 function as contact surfaces according to the invention.

A spacer anchoring nut housing portion 75 is formed on the side of the base surface 65 of the spacer 32, in the center of the width direction thereof. This spacer anchoring nut housing portion 75 is a recess that follows part of the shape of the spacer anchoring nut 27*b* when viewed from above, and is recessed partway into the spacer 32 from the base surface 65 in the thickness direction thereof. When the spacer anchoring nut 27*b* is embedded in the spacer anchoring nut housing portion 75 and is seated on the bottom of the recess, the orientation of the spacer anchoring nut 27*b* in the planar direction is regulated by the inner wall surface of the spacer anchoring nut housing portion 75. In other words, the spacer anchoring nut 27*b* is prevented from rotating when screwed onto the spacer anchoring bolt 27*a*. Furthermore, the head insertion hole 68 is provided in the bottom of the recess that is the spacer anchoring nut housing portion 75. Furthermore, a total of two positioning holes 77 that pass through the spacer 32 in the thickness direction thereof are provided in a position that is between the central boss portion 66 and the side wall portions 67 in the spacer 32 and that is distanced from the head anchoring nut housing portions 72. These positioning holes 77*a* and 77*b* are formed in positions that are horizontally symmetrical relative to the center of the spacer 32 in the width direction thereof.

The positioning holes 77 according to this embodiment are through-holes that are circular when viewed from above. Of the pair of positioning holes 77, the one positioning hole 77*a* (on the left side in FIG. 21B) is provided in the spacer 32 in a position that corresponds to the round hole 76*a* when that spacer 32 is attached to the flange portion 57*a*. On the other hand, the other positioning hole 77*b* (on the right side in FIG. 21B) is provided in the spacer 32 in a position that corresponds to the oblong hole 76*b* when that spacer 32 is attached to the flange portion 57*b*. In other words, the positioning hole 77*a* that corresponds to the round hole 76*a* of the flange portion 57*a* and the positioning hole 77*b* that corresponds to the oblong hole 76*b* of the flange portion 57*b* are provided in each spacer 32.

Figure 24:
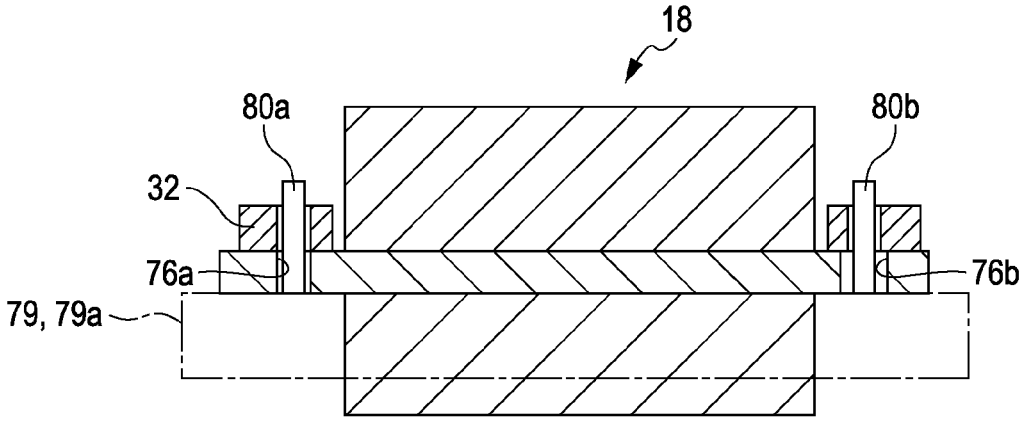
FIG. 24 is a schematic diagram illustrating a procedure for positioning a spacer relative to a recording head.

Next, a process for positioning the stated spacers 32 relative to the flange portions 57*a* and 57*b* on both sides of the recording head 18 will be described with reference to the schematic diagram shown in FIG. 24. In this spacer positioning process, first, the recording head 18 is set onto the positioning tool 79. A pair of positioning pins 80*a* and 80*b* are erected from the positioning tool 79, and the one positioning pin 80*a* is inserted into the round hole 76*a* of the flange portion 75*a*, whereas the other positioning pin 80*b* is inserted into the oblong hole 76*b* of the flange portion 75*b*; as a result, the position of the recording head 18 relative to the positioning tool 79 in the planar direction (that is, the surface direction parallel to the nozzle formation surface) is regulated. Here, because the inner diameter of the oblong hole 76*b* in the direction in which the positioning holes are arranged (that is, the long-side diameter) is set to be greater than the outer diameter of the positioning pin 80, the error between the interval between the round hole 76*a* and the oblong hole 76*b* and the interval between the positioning pins 80*a* and 80*b* is allowed for within the range of a gap that occurs between the positioning pin 80*b* and the oblong hole 76*b*.

If the recording head 18 has been set on the positioning tool 79, the spacers 32 are disposed on the respective flange portions 57*a* and 57*b* on both sides of the recording head 18. The spacers 32 are disposed relative to the flange portions 57 with the insertion hole periphery portions 73 opposite to the opening periphery portions 61 of the flange portions 57 and with the tool cutouts 71 oriented symmetrically relative to the center of the main head unit facing in opposite directions from each other (that is, outward) (in other words, in orientations rotated 180°. At this time, the spacer 32 disposed on the one flange portion 57*a* is positioned relative to that flange portion 57*a* by inserting the one positioning pin 80*a* that protrudes from the round hole 76*a* in the flange portion 57*a* into the positioning hole 77*a*. Note that the rotation of the spacer 32 central to the positioning hole 77*a* is regulated by another tool that is not shown here. Likewise, the spacer 32 disposed on the other flange portion 57*b* is positioned relative to that flange portion 57*b* by inserting the other positioning pin 80*b* that protrudes from the oblong hole 76*b* in the flange portion 57*b* into the positioning hole 77*b*. The spacers 32 are then screwed down onto the flange portions 57, in their positioned states, using the spacer anchoring bolts 27*a* and the spacer anchoring nuts 27*b*. In this manner, the spacers 32 are positioned relative to and anchored to the flange portions 57*a* and 57*b* in orientations that are symmetrical relative to each other.

Here, when the spacers 32 are disposed on the flange portions 57 but before these two elements have been screwed down onto each other using the spacer anchoring bolts 27*a* and the spacer anchoring nuts 27*b*, the contact protrusion portions 62 and the contact protrusions 74 make contact with each other at both ends in the flange width direction as far as possible from the screw-down area, while a gap G (see FIG. 23) is created at the screw-down area between the spacers 32 and the flange portions 57 (the anticipated screw-down area), or in other words, is created between the opening periphery portions 61 of the spacer attachment holes 54 and the insertion hole periphery portions 73 of the head insertion holes 68. Through this, when the spacers 32 and the flange portions 57 have been screwed down onto each other using the spacer anchoring bolts 27*a* and the spacer anchoring nuts 27*b*, the contact protrusion portions 62 and the contact protrusions 74 make contact with each other before other areas on the outer sides, in the flange width direction, of the screw-down areas of the spacers 32 and the flange portions 57 and the screw-down areas of the spacers 32 and the sub-carriage 26. When the contact protrusion portions 62 and the contact protrusions 74 make contact, the positions and orientations of the spacers 32 in the height direction relative to the flange portions 57 are regulated. By employing such a configuration, tilting is suppressed from occurring between the recording head 18 and the spacers 32 in the direction orthogonal to an imaginary line that connects the screw-down areas of the two flange portions 57 to each other, or in this embodiment, the short-side direction of the recording head 18. Accordingly, even when the recording head 18 is attached to the sub-carriage 26 with the spacers 32 therebetween, the recording head 18 is suppressed from tilting in the short-side direction relative to the sub-carriage 26.

Once the spacers 32 have been anchored to the flange portions 57 on either side of the recording head 18, the recording head 18 is then positioned relative to the head attachment area of the sub-carriage 26. In this positioning process, for example, the nozzle formation surface 53 of the recording head 18 that has been set on the head attachment area on the base portion 26*a* of the sub-carriage 26 is monitored with an imaging unit such as a CCD camera or the like, and the position of the recording head 18 upon the base portion 26*a* is adjusted so that a predetermined plurality of (at least two) specific nozzles 51 in the nozzle formation surface 53 are positioned at a specified position. Once the recording head 18 to be attached has been positioned, the spacers 32 attached to that recording head 18 are temporarily anchored to the base portion 26*a* using an adhesive. Although a so-called instant adhesive whose primary component is cyanoacrylate is favorable for the adhesive used in this temporary anchoring, any desired adhesive can be used as long as it is rigid enough that, when the adhesive is in a fully-cured state, the recording head 18 is anchored to the sub-carriage 26 with no looseness. For example, it is also possible to employ an ultraviolet light-curable adhesive. In this case, it is desirable for the spacers 32 or the sub-carriage 26 to be manufactured from a light-transmissive material. Then, once the adhesive has cured, the spacers 32 are screwed down onto the base portion 26*a* using the head anchoring bolts 43*a* and the head anchoring nuts 43*b*, thus permanently anchoring the recording head 18*a* to the specified position on the base portion 26*a*.

The recording heads 18 are attached to the sub-carriage 26 through this procedure. After that, the flow channel member 24 is anchored to the sub-carriage 26. As described above, the flow channel member 24 is anchored to the sub-carriage 26 using the flow channel anchoring screws 45. At this time, the connection flow channels 40 of the flow channel member 24 are inserted into the flow channel connection portions 38 of the sub-tanks 37 in the recording heads 18 and are linked thereto in a fluid-tight state. Note that the flow channel member 24 may be anchored to the sub-carriage 26 prior to the recording heads 18 being attached to the sub-carriage 26.

The head unit 17 is completed when the aforementioned processes have been carried out. This head unit 17 is, as mentioned earlier, housed within the main carriage unit 12 in a state in which the nozzle formation surfaces 53 of the recording heads 18 are exposed from the base portion opening 19 in the base plate portion 12*a* of the main carriage unit 12, and the head unit 17 is anchored, using the head unit anchoring screws 22, to the main carriage unit 12 after having its attitude, such as its position, slope, and so on, adjusted relative to the main carriage unit 12.

As described thus far, the head unit 17 according to this embodiment includes the flange portions 57 to which the spacers 32 are anchored on both sides of the recording head 18 with the head case 52 therebetween, the spacer attachment holes 54 for attaching the spacers 32 are provided in the flange portions 57*a* and 57*b* in the center of the width direction orthogonal to the nozzle row 56 in the recording head 18 and the round hole 76*a* and oblong hole 76*b* that serve as a reference for positioning the flange portions 57*a* and 57*b* relative to the spacers 32 are provided in the flange portions 57*a* and 57*b* in positions that are distanced from the center line O in the width direction, the positioning holes 77*a* and 77*b* that serve as a reference for positioning the spacers 32 relative to the flange portions 57*a* and 57*b* are provided in the spacers 32 in positions that correspond to the round hole 76*a* and the oblong hole 76*b* in the flange portions 57*a* and 57*b*, and the spacers 32 are anchored to the flange portions 57*a* and 57*b* on both sides so as to be oriented symmetrically to each other, in a positioned state in which the positions of the positioning holes 77*a* and 77*b* are aligned with the round hole 76*a* and the oblong hole 76*b*; accordingly, the spacers 32 anchored to the respective flange portions 57*a* and 57*b* on both sides of the recording head 18 can be configured as common components, and the management of the shapes and dimensions thereof can be commonalized as well. Accordingly, variation in the shapes and dimensions of the spacers 32 is reduced. As a result, tilting of the recording head 18 relative to the sub carriage 26 caused by such variation in the shapes and dimensions of the spacers 32 can be suppressed to the greatest extent possible. In particular, because the positioning holes 77*a* and 77*b* are provided in a total of two locations in the spacers 32 in correspondence to the round hole 76*a* and the oblong hole 76*b* in the flange portions 57*a* and 57*b*, it is possible to commonalize the spacers 32 even in a configuration in which the round hole 76*a* and the oblong hole 76*b* are provided in positions distanced from the center line in the width direction of the flange portions 57 by necessity due to the relationship between reducing to the greatest extent possible the size of the spacers 32 and providing the spacer attachment holes 54 in the center of the flange portions 57. Accordingly, variation in the shapes and dimensions of the spacers 32 can be reduced. Furthermore, by employing a configuration in which the spacers 32 are attached to the respective flange portions 57*a* and 57*b* in orientations that are symmetrical to each other with 180° rotation, it is possible to reduce the dimensions of the flange portions 57*a* and 57*b* in the nozzle row direction to the greatest extent possible, as opposed to the case where the spacers 32 are attached with the same orientations. Accordingly, it is possible to reduce the size of the head unit 17 that includes the sub carriage 26, and thus it is possible in turn to reduce the size of the printer 1.

In addition, the width of the spacers 32 in the direction orthogonal to the nozzle rows 56 is narrower than the width of the recording head 18 in the direction orthogonal to the nozzle rows, and thus in the case where a plurality of recording heads 18 have been disposed in a row, interference among intermediate members between adjacent liquid ejecting heads is prevented. Accordingly, the pitch of the recording heads 18 on the sub carriage 26 can be reduced. As a result, it is possible to reduce the size of the head unit 17, and thus it is possible in turn to reduce the size of the printer 1.

Note that it is desirable for at least the spacers 32 that are anchored to the flange portions 57 on both sides of the same recording head 18 to be manufactured using the same metal mold. Doing so makes it possible to make the dimensions and shapes of the spacers 32 anchored to the flange portions 57 on both sides of the same recording head 18 as close to uniform as possible. Accordingly, it is possible to prevent tilting of the recording head 18 relative to the sub carriage 26 with even more certainty.

In addition, it is desirable to employ a configuration in which a wrapping process, which polishes and smoothes the leading end surfaces of the contact protrusions 74 of the spacers 32 anchored to the flange portions 57 on both sides of the same recording head 18, is carried out on those leading end surfaces simultaneously. Employing such a configuration makes it possible to make the dimensions and shapes of the spacers 32 even more uniform. In particular, the dimension in the height direction from the base surface 65 of the spacers 32 to the leading end surface of the contact protrusions 74 can be made uniform among spacers 32 to a high level of precision, which in turn makes it possible to prevent tilting of the recording head 18 relative to the sub carriage 26 with an even higher degree of certainty.

It should be noted that the invention is not limited to the above-described embodiment, and many variations based on the content of the appended aspects of the invention are possible.

For example, although the aforementioned embodiment illustrates an example of a configuration in which ink is ejected while moving the recording heads 18 back and forth relative to the recording medium, the invention is not limited thereto. For example, a configuration in which the positions of the recording heads 18 are fixed and the ink is ejected while moving the recording medium relative to the recording heads 18 can be employed as well.

Furthermore, although the foregoing describes the ink jet printer 1, which is a type of liquid ejecting apparatus, as an example, the invention can also be applied in other liquid ejecting apparatuses that employ configurations in which a liquid ejecting head is anchored to a head anchoring member with a intermediate member provided therebetween. For example, the invention can also be applied in display manufacturing apparatuses for manufacturing color filters for liquid-crystal displays and so on, electrode manufacturing apparatuses for forming electrodes for organic EL (electroluminescence) displays, FEDs (front emission displays), and so on, chip manufacturing apparatuses for manufacturing biochips (biochemical devices), micropipettes for supplying precise small amounts of sample solutions, and so on.

What is claimed is:

1. A liquid ejecting head unit comprising:

a liquid ejecting head including a nozzle formation surface in which a nozzle row configured by arranging a plurality of nozzles that eject a liquid in a row is formed; and a head anchoring member to which the liquid ejecting head is anchored with intermediate members provided therebetween, wherein the liquid ejecting head includes intermediate member anchoring portions, to which the intermediate member is anchored and abutted thereto, at both ends with a main head unit therebetween;

intermediate member attachment holes for attaching the intermediate members are provided in each of the intermediate member anchoring portions in the center of the width direction that is orthogonal to the nozzle row in the liquid ejecting head, and head-side positioning holes that serve as a reference for positioning relative to the intermediate member are provided in the intermediate member anchoring portion in positions that are distanced from a centerline of the width direction;

intermediate member-side positioning holes that serve as a reference for positioning relative to the intermediate member anchoring portions are provided in each intermediate member in a position that corresponds to the head-side positioning hole of the corresponding intermediate member anchoring portion;

the intermediate members are anchored to the intermediate member anchoring portions on both sides so as to be oriented symmetrically to each other, in a positioned state in which the positions of the intermediate member-side positioning holes are aligned with the head-side positioning holes;

the head anchoring member is anchored to the intermediate members by the head anchoring bolts, and the intermediate members are anchored to the intermediate member anchoring portions by spacer anchoring bolts.

2. The liquid ejecting head unit according to claim 1, wherein each of the intermediate members anchored to the same liquid ejecting head are manufactured from the same metal mold.

3. The liquid ejecting head unit according to claim 1, wherein the width of the intermediate members in the direction orthogonal to the nozzle row is narrower than the width of the liquid ejecting head in the direction orthogonal to the nozzle row.

4. The liquid ejecting head unit according to claim 1, wherein each of the head-side positioning holes of the intermediate member anchoring portions on both sides of the liquid ejecting head are provided in positions that are distanced by the same amount from the center line toward one side in the direction orthogonal to the nozzle row.

5. The liquid ejecting head unit according to claim 1, wherein of the head-side positioning holes provided in the intermediate member anchoring portions on both sides of the liquid ejecting head, one of the holes is round in shape, and the other of the holes is an oblong hole that is longer in the direction in which the positioning holes are arranged.

6. The liquid ejecting head unit according to claim 1, wherein a wrapping process is carried out simultaneously on contact surfaces, in the intermediate members anchored to the liquid ejecting head, into which the intermediate member anchoring portions come into contact.

7. A liquid ejecting apparatus provided with a liquid ejecting head unit that includes a liquid ejecting head having a nozzle formation surface in which a nozzle row configured by arranging a plurality of nozzles that eject a liquid in a row is formed and a head anchoring member to which the liquid ejecting head is anchored with intermediate members provided therebetween, wherein the liquid ejecting head includes intermediate member anchoring portions, to which the intermediate member is anchored and abutted thereto, at both ends with a main head unit therebetween;

intermediate member attachment holes for attaching the intermediate member are provided in each of the intermediate member anchoring portions in the center of the width direction that is orthogonal to the nozzle row in the liquid ejecting head, and head-side positioning holes that serve as a reference for positioning relative to the intermediate member are provided in the intermediate member anchoring portion in positions that are distanced from a centerline of the width direction;

intermediate member-side positioning holes that serve as a reference for positioning relative to the intermediate member anchoring portions are provided in each intermediate member in a position that corresponds to the head-side positioning hole of the corresponding intermediate member anchoring portion;

the intermediate members are anchored to the intermediate member anchoring portions on both sides so as to be oriented symmetrically to each other, in a positioned state in which the positions of the intermediate member-side positioning holes are aligned with the head-side positioning holes;

the head anchoring member is anchored to the intermediate members by the head anchoring bolts, and the intermediate members are anchored to the intermediate member anchoring portions by spacer anchoring bolts.

* * * * *